US006463920B1

(12) United States Patent
Kondo et al.

(10) Patent No.: US 6,463,920 B1
(45) Date of Patent: Oct. 15, 2002

(54) WORK CUTTING APPARATUS AND WORK CUTTING METHOD

(75) Inventors: Sadahiko Kondo, Takarazuka; Toshifumi Hiyoke, Muko, both of (JP); Toshiaki Sasaki, Makati (PH)

(73) Assignee: Sumitomo Special Metals Co., Ltd., Osaka (JP)

( * ) Notice: Subject to any disclaimer, the term of this patent is extended or adjusted under 35 U.S.C. 154(b) by 13 days.

(21) Appl. No.: 09/712,905

(22) Filed: Nov. 16, 2000

(30) Foreign Application Priority Data

Nov. 22, 1999 (JP) ..... 11-332118

(51) Int. Cl.[7] ..... B28D 1/04

(52) U.S. Cl. ..... 125/15; 125/13.01; 125/18; 125/16.01; 125/4.22

(58) Field of Search ..... 125/15, 11.22, 125/12, 13.01, 18; 457/449, 450, 540–541, 910, 165

(56) References Cited

U.S. PATENT DOCUMENTS 2,511,962 A * 6/1950 Barnes ..... 125/13.01
2,967,381 A * 1/1961 Brown ..... 125/13.01
3,081,586 A * 3/1963 Gersbach ..... 125/13.01
3,240,243 A * 3/1966 Golick ..... 125/11.22
4,633,847 A * 1/1987 Lossl et al. ..... 125/13 R
4,930,486 A * 6/1990 Kuromatsu ..... 125/11.01
4,962,748 A * 10/1990 Schweickhardt ..... 125/13.01
5,711,287 A * 1/1998 Speer ..... 125/16.01
6,012,977 A * 1/2000 Yoshikawa et al. ..... 451/541

FOREIGN PATENT DOCUMENTS

JP 62-178066 11/1987
JP 6-49275 6/1994

* cited by examiner

*Primary Examiner*—George Nguyen
(74) *Attorney, Agent, or Firm*—Armstrong, Westerman & Hattori, LLP.

(57) ABSTRACT

A work cutting apparatus comprises a plurality of cutting blades each including a metal plate phase containing a super hard abrasive grain dispersed entirely thereon. A work made of a rare-earth alloy magnet member is submerged in a coolant in a container. The work submerged in the coolant is cut by rotating the cutting blades at a high speed not slower than 8000 rpm and by moving the cutting blades to the work vertically or along a normal line passing a tangential point between the cutting blade and the work. The coolant may be supplied from a hose to a cutting region at a time of the cutting. At the time of cutting, the work is vibrated in a direction parallel to a main surface of the cutting blade and perpendicular to a direction of the cutting. Preferably, the cutting blade has a tip portion formed with a cutout, and a spacer including two main surfaces each having an outer circumferential portion formed with an annular stepped portion is inserted between the cutting blades.

28 Claims, 22 Drawing Sheets

Stroke in Z-feeding

Stroke in X-feeding

Comparison between X-feeding and Z-feeding
(Electrocast cutting blades : 0.3t×2 blades)

| | X-feeding | Z-feeding | | |
|---|---|---|---|---|
| Cutting speed (mm/min) | 5 | 2 | | |
| Cutting blade rpm | 8000 | 8000 | | |
| Coolant | supplied by discharge | supplied by discharge | | |
| Dimensional inconsistency (mm) | | First cut | Second cut | Average |
| <Left side> | 0.545 | 0.110 | 0.094 | 0.102 |
| <Right side> | 0.488 | 0.092 | 0.071 | 0.082 |
| <Total> | 0.786 | 0.131 | 0.104 | 0.118 |

Comparison between Different Cutting Blade rpm's
(Electrocast cutting blades : 0.3t×2 blades)

| Cutting blade rpm | 3600 | | | 8000 | | | |
|---|---|---|---|---|---|---|---|
| Coolant | submersion | | | submersion | | | |
| Cutting method | Z-feeding | | | Z-feeding | | | |
| Cutting speed (mm/min) | 1 | 2 | 3 | 1 | 2 | 4 | 6 |
| Dimensional inconsistency (mm) | n=3 | n=3 | n=3 | n=3 | n=3 | n=3 | n=3 |
| <Left side> | 0.229 | 0.118 | <seizure> | 0.044 | 0.044 | 0.076 | 0.079 |
| <Right side> | 0.316 | 0.118 | | 0.066 | 0.075 | 0.073 | 0.078 |
| <Total> | 0.361 | 0.141 | | 0.110 | 0.108 | 0.093 | 0.089 |

Comparison between Different Coolant Supplying Methods
(Electrocast cutting blades : 0.3t×2 blades)

| Coolant | supplied by discharge | | | submersion | | | |
|---|---|---|---|---|---|---|---|
| Cutting blade rpm | 8000 | | | 8000 | | | |
| Cutting method | Z-feeding | | | Z-feeding | | | |
| Cutting speed (mm/min) | 1 | 2 | 3 | 1 | 2 | 4 | 6 |
| Dimensional inconsistency (mm) | n=3 | n=3 | n=3 | n=3 | n=3 | n=3 | n=3 |
| <Left side> | 0.081 | 0.080 | <seizure> | 0.044 | 0.044 | 0.076 | 0.079 |
| <Right side> | 0.119 | 0.148 | | 0.066 | 0.075 | 0.073 | 0.078 |
| <Total> | 0.141 | 0.186 | | 0.110 | 0.108 | 0.093 | 0.089 |

FIG. 18A

Shape of Spacer and Cutting Accuracy
(Electrocast cutting blades : 0.3t×5 blades)

| Shape of spacer | | Without annular stepped portion | | | | With annular stepped portion | | | |
|---|---|---|---|---|---|---|---|---|---|
| Amount of projection (mm) | | 20 | | | | 20 | | | |
| Cutting speed (mm/min) | | 2 | | | | 2 | | | |
| Cutting blade rpm | | 8000 | | | | 8000 | | | |
| Coolant | | submersion, supplied at 2kgf/cm² | | | | submersion, supplied at 2kgf/cm² | | | |
| Target thickness (mm) | | 2.0 | | | | 2.0 | | | |
| Cutting acurracy (mm) | | First cut | Second cut | Third cut | Average | First cut | Second cut | Third cut | Average |
| max-min | No.1 | 0.034 | 0.036 | 0.027 | | 0.032 | 0.024 | 0.028 | |
| | No.2 | 0.012 | 0.017 | 0.025 | | 0.010 | 0.010 | 0.011 | |
| | No.3 | 0.032 | 0.032 | 0.030 | | 0.007 | 0.017 | 0.018 | |
| | No.4 | 0.025 | 0.060 | 0.038 | | 0.020 | 0.019 | 0.018 | |
| Parallelism (mm) | | 0.026 | 0.036 | 0.030 | 0.031 | 0.017 | 0.017 | 0.019 | 0.018 |
| Dimensional inconsistency (mm) | | 0.168 | 0.142 | 0.131 | 0.147 | 0.096 | 0.083 | 0.087 | 0.089 |

FIG. 18B

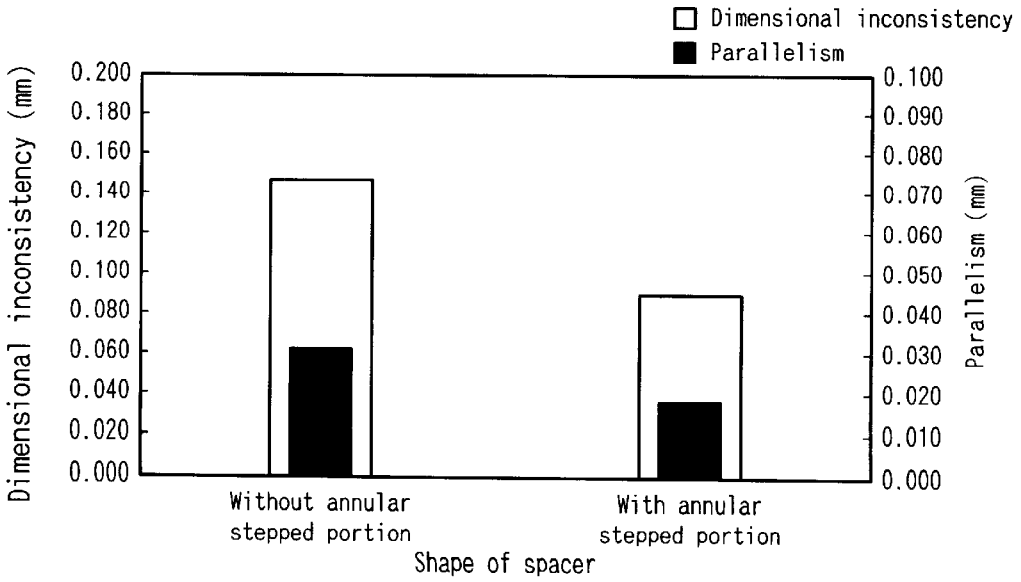

Effect of Cutouts
(Electrocast cutting blades : 0.3t×4 blades)

| Cutting conditions | | | | Dimensional inconsistency (mm) |
|---|---|---|---|---|
| Amount of projection (mm) | Cutouts | Cutting blade rpm | Cutting speed (mm/min) | |
| 20 | With cutouts | 8000 | 2 | 0.085 |
| | | | 4 | 0.122 |
| | | | 6 | 0.186 |
| | | 3600 | 2 | 0.060 |
| | | | 4 | 0.064 |
| | | | 6 | 0.052 |
| | Without cutouts | 8000 | 2 | 0.130 |
| | | | 4 | 0.168 |
| | | | 6 | 0.188 |
| | | 3600 | 2 | 0.195 |
| | | | 4 | 0.180 |
| | | | 6 | 0.217 |

WORK CUTTING APPARATUS AND WORK CUTTING METHOD

BACKGROUND OF THE INVENTION

1. Field of the Invention

The present invention relates to a work cutting apparatus and a work cutting method, and more specifically to a work cutting apparatus and a work cutting method utilizing a cutting blade having a surface containing a super hard abrasive grain dispersed entirely therein.

2. Description of the Related Art

Conventionally, an electrocast cutting blade having a small blade thickness is proposed as a cutting blade capable of reducing an amount of removed material cut from a work. This cutting blade is formed, as disclosed in the Japanese Patent Publication (of examined Application for opposition) No. 6-49275 for example, by dispersing a super hard abrasive grain made of such a material as diamond, cBN and so on in a metal plate phase of Ni and Co. The cutting blade is primarily used for cutting a substrate for a magnetic head.

When the cutting blade is used to cut a hard, brittle and thick work such as a rare-earth magnet member, an amount of projection of the cutting blade must be increased. However, due to reasons such as the small thickness of the blade, rigidity of the cutting blade decreases, sometimes causing the cutting blade to deform during the cutting, resulting in decrease in cutting accuracy.

Further, when the work is cut by using such a cutting blade as described above, there is only a small difference between a thickness in an outer circumferential portion and a thickness in a center portion of the cutting blade. Thus, there is only a small clearance essential to supply coolant to a cutting region of the work. Therefore, if a section of the work to be made by the cutting has a large area, and especially if a deep groove is cut in the work during the cutting operation, it becomes impossible to sufficiently supply the coolant to the cutting region, causing the cutting blade to be seized easily, resulting in a problem of shortened life of the cutting blade.

SUMMARY OF THE INVENTION

It is therefore a primary object of the present invention to provide a work cutting apparatus and a work cutting method capable of improving cutting accuracy even when cutting the work which has a relatively large thickness.

Another object of the present invention is to provide a work cutting apparatus and a work cutting method capable of increasing the life of the cutting blade.

According to an aspect of the present invention, there is provided a work cutting apparatus for cutting a work, comprising: a cutting blade having a surface containing a super hard abrasive grain dispersed entirely therein; first driving means for rotation of the cutting blade; and second driving means for moving at least one of the cutting blade and the work in a direction in which movement of the cutting blade relative to the work at a time of cutting is vertical to the work.

According to another aspect of the present invention, there is provided a work cutting method for cutting a work, comprising: a first step of preparing a cutting blade having a surface containing a super hard abrasive grain dispersed entirely therein; and a second step of cutting the work with the cutting blade by rotating the cutting blade and moving at least one of the cutting blade and the work in a direction in which movement of the cutting blade relative to the work is vertical to the work.

According to the present invention, for example, by lowering the rotating cutting blade thereby cutting into the work disposed at a predetermined position, a force acting to deform the cutting blade can be decreased and therefore a load exerted to the cutting blade is decreased. Further, dynamic rigidity of the cutting blade can be increased if the cutting blade is rotated at a high speed. Therefore, the cutting blade becomes less susceptible to deformation, and thus it becomes possible to stabilize the cutting and improve cutting accuracy even if the work to be cut has a relatively large thickness.

According to another aspect of the present invention, there is provided a work cutting apparatus for cutting a work, comprising: a cutting blade having a surface containing a super hard abrasive grain dispersed entirely therein; first driving means for rotation of the cutting blade; and second driving means for moving at least one of the cutting blade and the work in a direction in which movement of the cutting blade relative to the work at a time of cutting is along a normal line passing a tangential point between the cutting blade and the work.

According to still another aspect of the present invention, there is provided a work cutting method for cutting a work, comprising: a first step of preparing a cutting blade having a surface containing a super hard abrasive grain dispersed entirely therein; and a second step of cutting the work with the cutting blade by rotating the cutting blade and moving at least one of the cutting blade and the work in a direction in which movement of the cutting blade relative to the work is along a normal line passing a tangential point between the cutting blade and the work.

According to the present invention, for example, by cutting into the work disposed at a predetermined position, with the rotating cutting blade along a normal line passing a tangential point with the work, the cutting blade becomes less susceptible to deformation as in the invention described above, making possible to improve cutting accuracy even if the work to be cut has a relatively large thickness.

According to another aspect of the present invention, there is provided a work cutting apparatus for cutting a work, comprising: a container holding a coolant for submerging the work, a cutting blade having a surface containing a super hard abrasive grain dispersed entirely therein; first driving means for rotation of the cutting blade; and second driving means for moving at least one of the cutting blade and the work for cutting the work submerged in the coolant.

According to still another aspect of the present invention, there is provided a work cutting method for cutting a work, comprising: a first step of preparing a cutting blade having a surface containing a super hard abrasive grain dispersed entirely therein; and a second step of cutting the work submerged in the coolant with the cutting blade by rotating the cutting blade and moving at least one of the cutting blade and the work.

According to the present invention, since the cutting is made to the work submerged in the coolant, the coolant can be supplied sufficiently to the cutting region even if the clearance between the work and the cutting blade, which is essential for supplying the coolant to the cutting region of the work, is small. As a result, seizure of the cutting blade can be prevented, making possible to increase the life of the cutting blade.

Preferably, the coolant is also supplied positively to the work. When the cutting blade is rotated at a high speed, an airflow accompanying the rotating cutting blade removes the coolant from a surface of the work for example, sometimes making impossible to supply the coolant sufficiently to the cutting region. However, by supplying the coolant positively to the work, the work can be sufficiently submerged in the coolant, preventing the seizure of the cutting blade more reliably.

Further, preferably, a plurality of the cutting blades and a spacer including two main surfaces each having an outer circumferential portion formed with an annular stepped portion are prepared, and the spacer is inserted between two mutually adjacent cutting blades. In the cutting blade having the surface containing the super hard abrasive grain dispersed entirely therein, if an area of contact between the cutting blade and the spacer is large, the number of the abrasive grains contacting the spacer increases, which sometimes increases an amount of tilt of the cutting blade. However, by using a spacer having the annular stepped portions as described above, the area of contact between the spacer and the super hard abrasive grains dispersed in a side surface of the cutting blade is decreased, decreasing the amount of tilt of the cutting blade when the cutting blade is attached.

Further, preferably, the cutting blade is formed by means of electrocasting for example, and includes a metal plate phase containing the super hard abrasive grain dispersed thereon. This provides a desired cutting blade having a small blade thickness, making possible to reduce the amount of material ground off the work.

Preferably, a cutout is formed in a tip portion of the cutting blade. This helps supplying the coolant to a cutting edge of the cutting blade, resulting in reduced dimensional inconsistency of a member obtained by cutting the work.

Further, preferably, the cutting blade is rotated at a high speed not slower than 8000 rpm. This can centrifugally increase dynamic rigidity of the cutting blade. Therefore, the cutting blade is not distorted during the cutting, and thus side surfaces of the cutting blade do not contact the work during the cutting. As a result, cutting accuracy can be maintained and the seizure of the cutting blade can be eliminated, increasing the life of the cutting blade.

Further, preferably, the work is vibrated at the time of cutting, in a direction parallel to a main surface of the cutting blade. With this arrangement, the cutting blade can be periodically spaced from the cutting region, making easier to supply the coolant to the cutting region. Further, the cutting blade is allowed to come back from a deformed state to a correct state, making possible to improve the cutting accuracy.

Preferably, a vibrating direction of the work is perpendicular to the direction of movement of the cutting blade relative to the work. With this arrangement, it becomes possible to further reduce the cutting load exerted to the cutting blade. Therefore, the cutting blade becomes less susceptible to deformation, making possible to improve the cutting accuracy.

The present invention is especially effective if the work is a rare-earth alloy magnet member which is hard, brittle and difficult to cut.

The above objects, other objects, characteristics, aspects and advantages of the present invention will become clearer from the following description of embodiments to be presented with reference to the accompanying drawings.

BRIEF DESCRIPTION OF THE DRAWINGS

FIG. 18A is a table showing, results of an experiment example 4;

FIG. 18B is a graphical representation of the same;

DETAILED DESCRIPTION OF THE PREFERRED EMBODIMENTS

Now, an embodiment of the present invention will be described with reference to the accompanying drawings.

Figure 1:
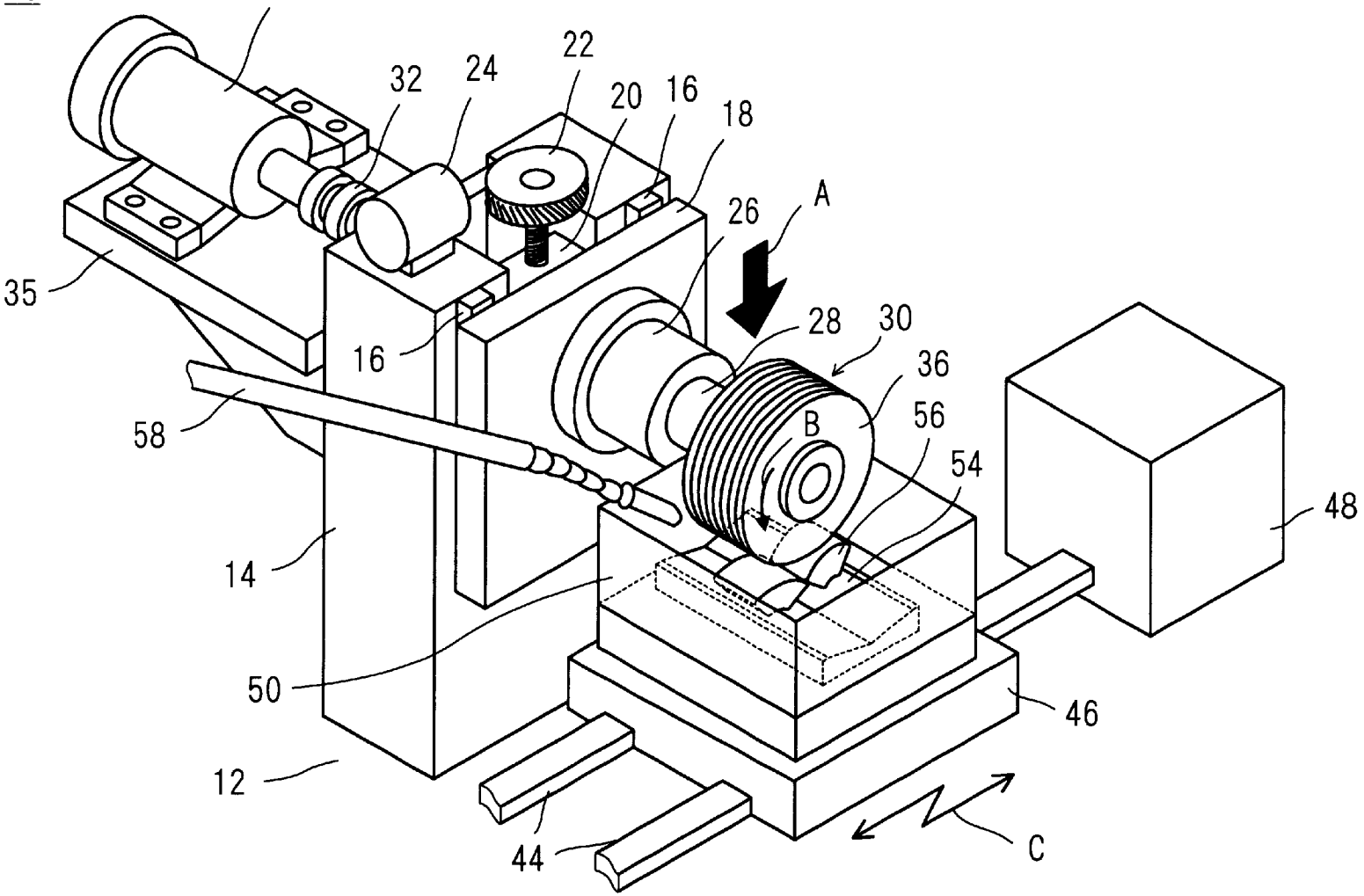
FIG. 1 is a perspective view showing an embodiment of the present invention.

Referring to FIG. 1, a work cutting apparatus 10 as an embodiment of the present invention is a so-called cantilever-type disc-blade cutting apparatus, and comprises a bed 12. The bed 12 has an upper surface provided with a column 14. The column 14 has a front surface formed with a pair of rails 16 parallel to each other, running in the vertical direction (along a Z axis). The pair of rails 16 guide a slider 18 which is slidable in vertical directions. The slider 18 has a back surface provided with a slider supporting portion 20 formed with a vertical threaded hole. The threaded hole of the slider supporting portion 20 is threaded by a screw 22 serving as a feeding shaft for cutting. The screw 22 is rotated by a lifting motor 24 disposed on the column 14. Therefore, the lifting motor 24 controls turning of the screw 22, thereby vertically moving the slider 18 via the slider supporting portion 20. When cutting, a block of cutting blades 30 to be described later is fed in a direction of arrow A (downward direction).

Further, the slider 18 has a front surface provided with a supporting portion 26. The supporting portion 26 rotatably supports a rotating shaft 28.

The rotating shaft 28 has an end portion mounted with a cutting blade block 30. The rotating shaft 28 has another end portion connected to a high-speed electric motor 34 via a coupling 32. The high-speed motor 34 is disposed on a base 35. The high-speed motor 34 rotates the rotating shaft 28 and the cutting blade block 30 in a direction indicated by an arrow B for example. Rotating speed of the cutting blade block 30 is not slower than 8000 rpm preferably. The high-speed motor 34 moves vertically, accompanying the cutting blade block 30.

Figure 2:
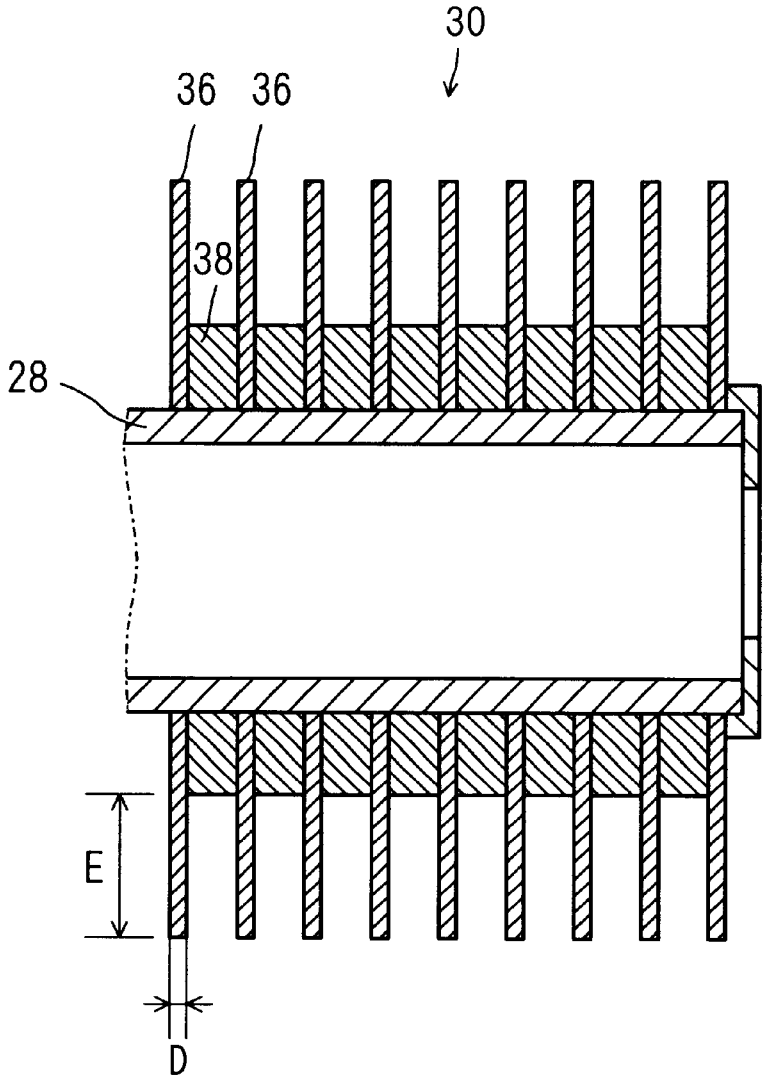
FIG. 2 is a sectional view showing a primary portion of a cutting blade block.

Referring to FIG. 2, the cutting blade block 30 includes a plurality of cutting blades 36 and a plurality of annular spacers 38 each inserted between a pair of mutually adjacent cutting blades 36.

Figure 3A:
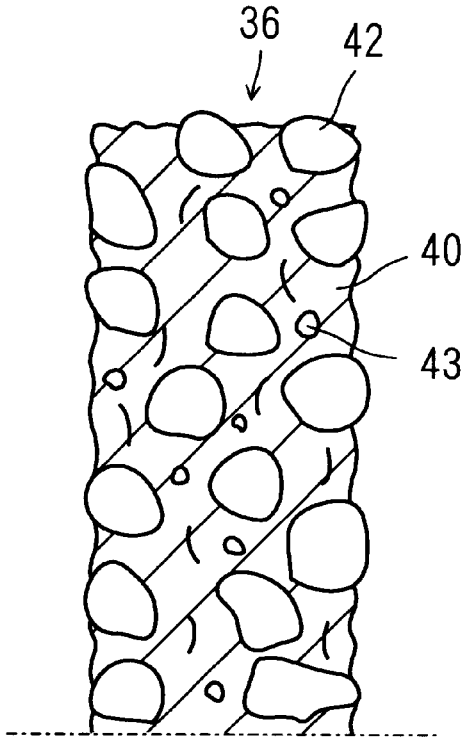
FIG. 3A is a partially eliminated sectional side view showing a cutting blade.
Figure 3B:
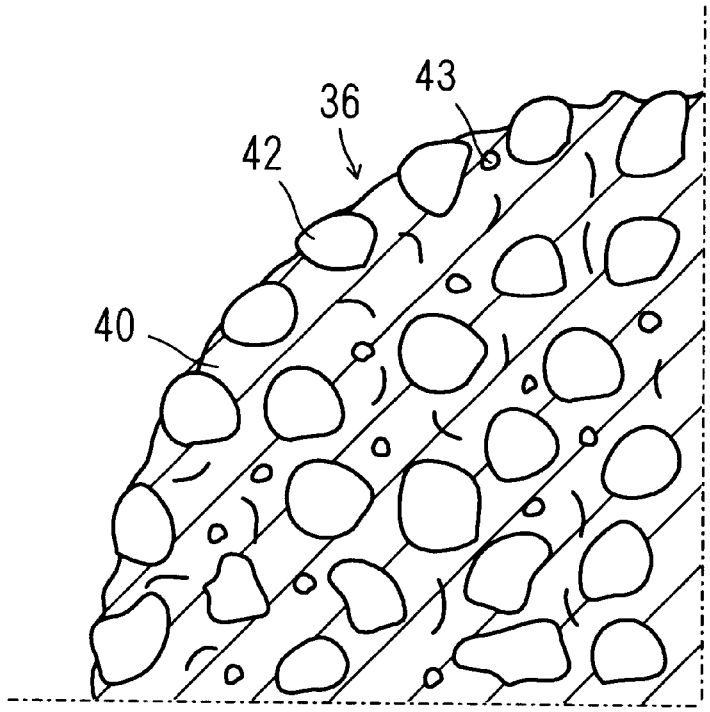
FIG. 3B is a partially eliminated sectional front view of the same.

As shown in FIG. 3A and FIG. 3B, the cutting blade 36 is of an all-blade type, having a metal plate phase 40 formed primarily of Ni and Co throughout which a super hard abrasive grain 42 is dispersed by electrocasting for example. Thus, a blade thickness D (See FIG. 2.) of the cutting blade 36 can be made small. By using the cutting blade 36 as described above, dynamic rigidity of the cutting blade 36 necessary for cutting a thick work 56 (to be described later) at a high rpm can be assured.

The super hard abrasive grain 42 may be such substance as natural or synthetic diamond powder, cBN (cubic-system boron nitride) powder, and a mixture of the natural or synthetic diamond powder and the cBN powder.

Preferably, the mixing rate of the super hard abrasive grain 42 by volume is 20%~30%. If the rate is smaller than 20%, cutting efficiency is low because an amount of cutting is extremely small for wear of the cutting blade 36. On the other hand, if the rate is greater than 30%, space between the super hard abrasive grains 42 is small, decreasing a chip pocket size, which allows sludge to stagnate at a cutting edge of the cutting blade 36, preventing smooth flow of a coolant 52 (to be described later) into and out of a cutting region 60 (to be described later). Therefore, a cutting load is increased, causing such problems as deformation and seizure of the cutting blade 36, resulting in decrease in cutting S accuracy. If the volume rate of the super hard abrasive grain 42 is 20%~30%, supply of the coolant 52 and discharge of the sludge are easy, and the super hard abrasive grain 42 can fall off smoothly, decreasing cutting resistance, smoothening the cutting, achieving high cutting efficiency and cutting accuracy.

The blade thickness D of the cutting blade 36 is preferably 0.1 mm~0.5 mm. Within this range, it becomes possible to reduce an amount of material (cutting margin) ground off the work 56, making possible to obtain a large number of members 62 (to be described later) out of the work 56. If the blade thickness D of the cutting blade 36 is smaller than 0.1 mm, rigidity of the cutting blade 36 is inappropriate. On the other hand, if the blade thickness D exceeds 0.5 mm, then the amount of material ground off the work 56 is too large. In either case, a problem arises.

Further, if distortion in the cutting blade 36 is removed by lapping with a diamond abrasive grain, the cutting accuracy can be improved further.

It should be noted here that the coolant 52 can be supplied to the cutting blades 36 and the work 56 more easily if the cutting blade 36 has pores 43.

Returning to FIG. 1, the base 12 has an upper surface provided with two rails 44. On the rails 44, a vibration table 46 is slidably mounted. The vibration table 46 is vibrated by a vibrator 48, so that the works 56 can be vibrated.

Direction of vibration of the vibrating table 46 or of the works 56 is, as indicated by an arrow C, in parallel to main surfaces of the cutting blades 36 and perpendicular to a direction of cutting indicated by an arrow A in which the feeding of the cutting blades 36 is made.

Further, vibration frequency of the works 56 is not smaller than 10 Hz preferably. In this case, load exerted to the cutting blades 36 is small, and therefore deformation in the cutting blades 36 can be corrected quickly, resulting in improved cutting accuracy.

Figure 4:
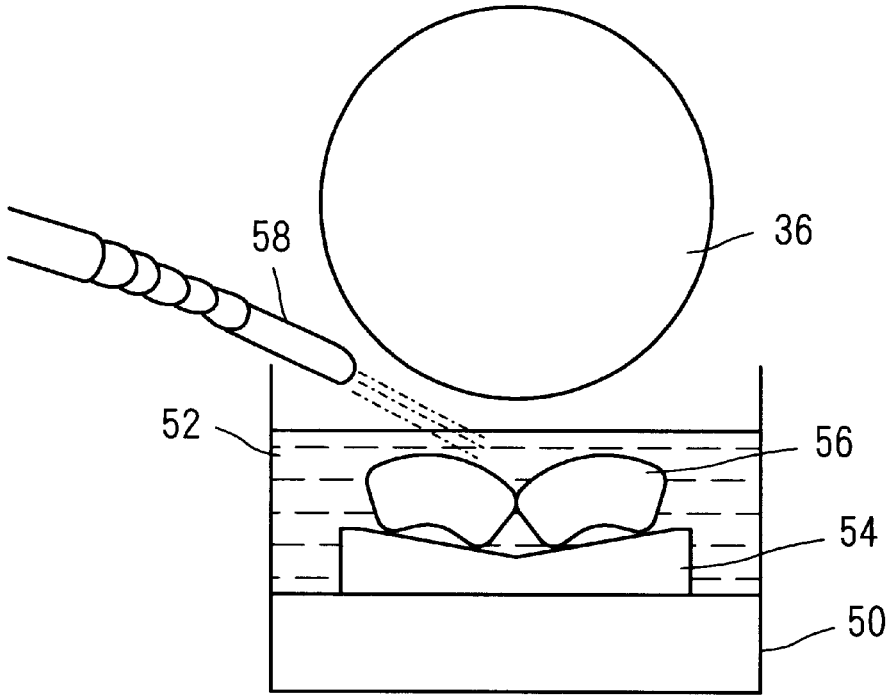
FIG. 4 is a diagram showing a primary portion of the embodiment in FIG. 1.

A container 50 is provided on the vibration table 46. As shown in FIG. 4, the container 50 holds the coolant 52. The coolant 52 is mainly made of water. The coolant 52 has a surface tension of 25 dyn/cm~60 dyn/cm preferably. If the main component is water, cooling effect is high, and if the surface tension is 25 dyn/cm~60 dyn/cm, permeability of the coolant 52 into the cutting region 60 is high, and the cutting efficiency is high.

The coolant 52 can include such additives as surfactant or synthetic type lubricant, rust inhibitor, non-ferrous metal anticorrosive, antiseptic and antifoaming agent.

The surfactant can be an anionic surfactant or a nonionic surfactant. Examples of the anionic surfactant are a fatty acid derivative such as fatty acid soap and naphthenic acid soap; a sulfate ester surfactant such as long-chain alcohol sulfate ester and sulfated oil of animal or vegetable oil; and a sulfonic acid surfactant such as petroleum sulfonate. Examples of the nonionic surfactant are a polyoxyethylene surfactant such as polyoxyethylene alkylphenyl ether and polyoxyethylene monofatty acid ester; a polyhydric alcohol surfactant such as sorbitan monofatty acid ester; and an alkylol amide surfactant such as fatty acid diethanol amide. Specifically, the surface tension and the coefficient of dynamic friction can be adjusted within the preferred ranges by adding to water approximately 2 wt % of a chemical solution type surfactant, JP-0497N (manufactured by Castrol Limited).

The synthetic type lubricant can be any of a synthetic solution type lubricant, a synthetic emulsion type lubricant and a synthetic soluble type lubricant, among which the synthetic solution type lubricant is preferred. Specific examples of the synthetic solution type lubricant are Syntairo 9954 (manufactured by Castrol Limited) and #880 (manufactured by Yushiro Chemical Industry Co., Ltd.). When any of these lubricants is added to water in a concentration of approximately 2 wt %, the surface tension and the coefficient of dynamic friction can be adjusted within the preferred ranges.

Furthermore, when the coolant 52 includes the rust inhibitor, corrosion of the rare-earth alloy can be prevented. In this embodiment, pH of the coolant 52 is preferably set to 9 through 11. The rust inhibitor can be organic or inorganic. Examples of the organic rust inhibitor are carboxylate such as oleate and benzoate, and amine such as triethanol amine, and examples of the inorganic rust inhibitor are phosphate, borate, molybdate, tungstate and carbonate.

An example of the non-ferrous metal anticorrosive is a nitrogen compound such as benzotriazole, and an example of the antiseptic is a formaldehyde donor such as hexahydrotriazine.

Silicone emulsion can be used as the antifoaming agent. When the coolant 52 includes an antifoaming agent, the coolant 52 can be prevented from foaming up so as to attain high permeability. As a result, the cooling effect can be enhanced, and the temperature increase at the cutting edge can be avoided. Thus, the abnormal temperature increase and the abnormal abrasion of the cutting edge of the cutting blade 36 can be suppressed.

The container 50 has a bottom surface provided with a draining hole (not illustrated) for draining the coolant 52. On the bottom surface of the container 50, a pasting board 54 formed with an upper surface having a V-shaped section is disposed. On the upper surface of the pasting board 54, a plurality, for example, of works 56 are fixed with an adhesive. In the container 50, the works 56 are submerged in the coolant 52. The works 56 may be such substance as a rare-earth alloy magnet member (disclosed in the U.S. Pat. Nos. 4,770,723 and 4,792,368) made of a neodymium alloy and so on.

Further, a hose 58 from the coolant supplying device (not illustrated) is disposed aiming inside the container 52. The coolant 52 is discharged from an end of the hose 58 to the works 56.

When cutting, the cutting blades 36 are rotated in the direction indicated by the arrow B and the slider 18 is slid in the direction indicated by the arrow A, thereby moving the cutting blades 36 relatively toward the works 56 at a constant speed, allowing the cutting blades 36 to cut the works 56 submerged in the coolant 52 into a predetermined dimension. At this time, the coolant 52 from the coolant supplying device is supplied through the hose 58 to the works 56 as needed.

According to the work cutting apparatus 10 as described above, the following effects can be obtained.

Figure 5:
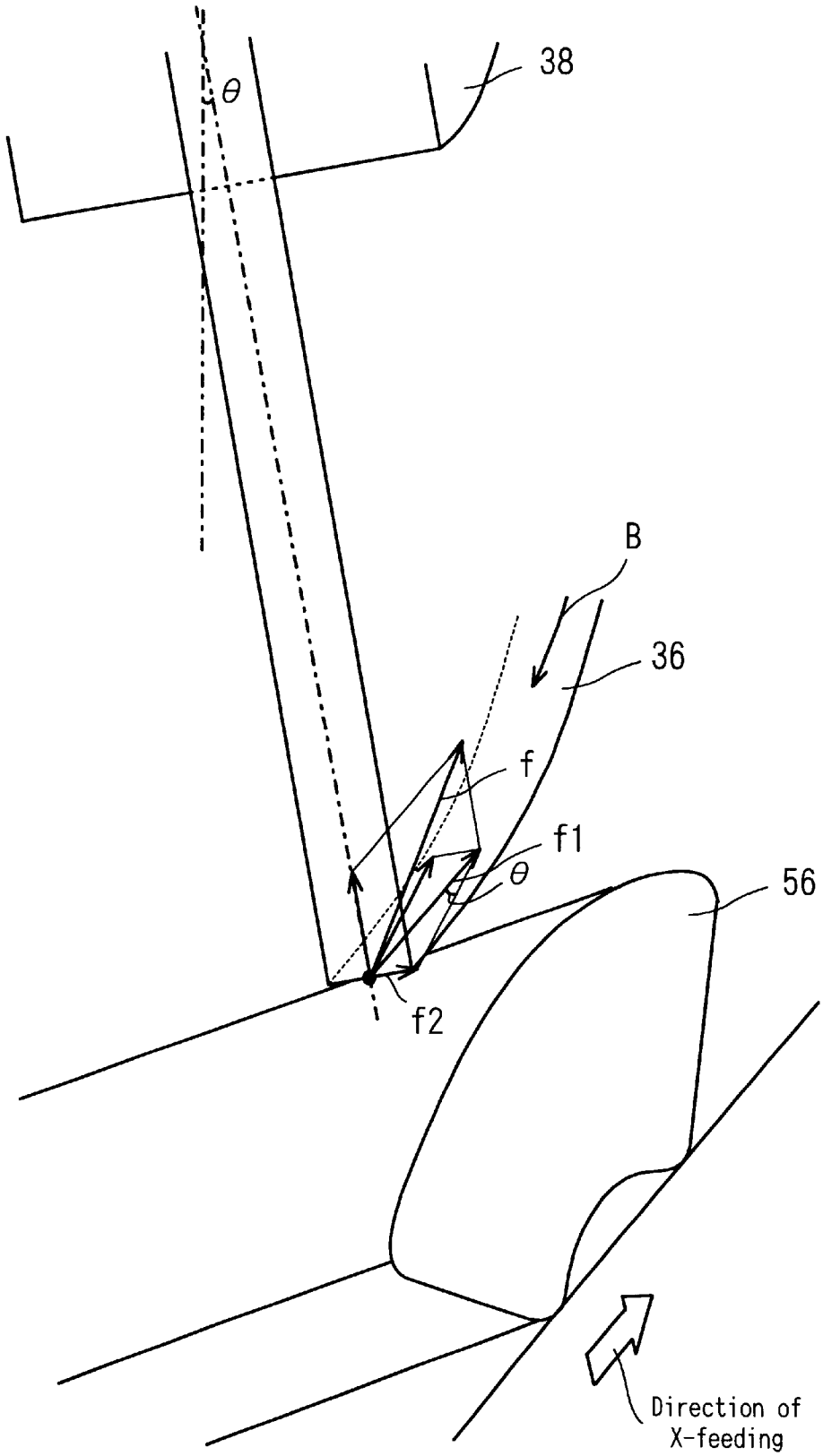
FIG. 5 is a diagram showing relationship of cutting reaction forces acting on the cutting blade during an X-feed cutting.

Specifically, in a work cutting apparatus in general, the cutting blade should ideally be mounted at exact right angle to the rotating shaft. In such a case, a cutting reaction will only develop within surface of the cutting blade, or no force causing the cutting blade to deform perpendicularly to a rotating plane of the cutting blade is generated. Actually however, as shown in FIG. 5, there is involved a cutting blade mounting error $\theta$ ($\theta$=0.02~0.04 degree approx.). When the work 56 is cut in X-feeding (i.e. by moving the cutting blade 36 horizontally) for example, cutting reaction f includes a tangential component force f1, which includes a component force f2 corresponding to the mounting error ($f2=f1\times\sin\theta$) acting as the force to deform the cutting blade 36. As a result, the cutting blade 36 is deformed, and cutting accuracy is reduced. The same problem occurs even if the cutting blade 36 is formed by electrocasting and there is no mirror symmetry in the thickness of the cutting blade 36.

Figure 6:
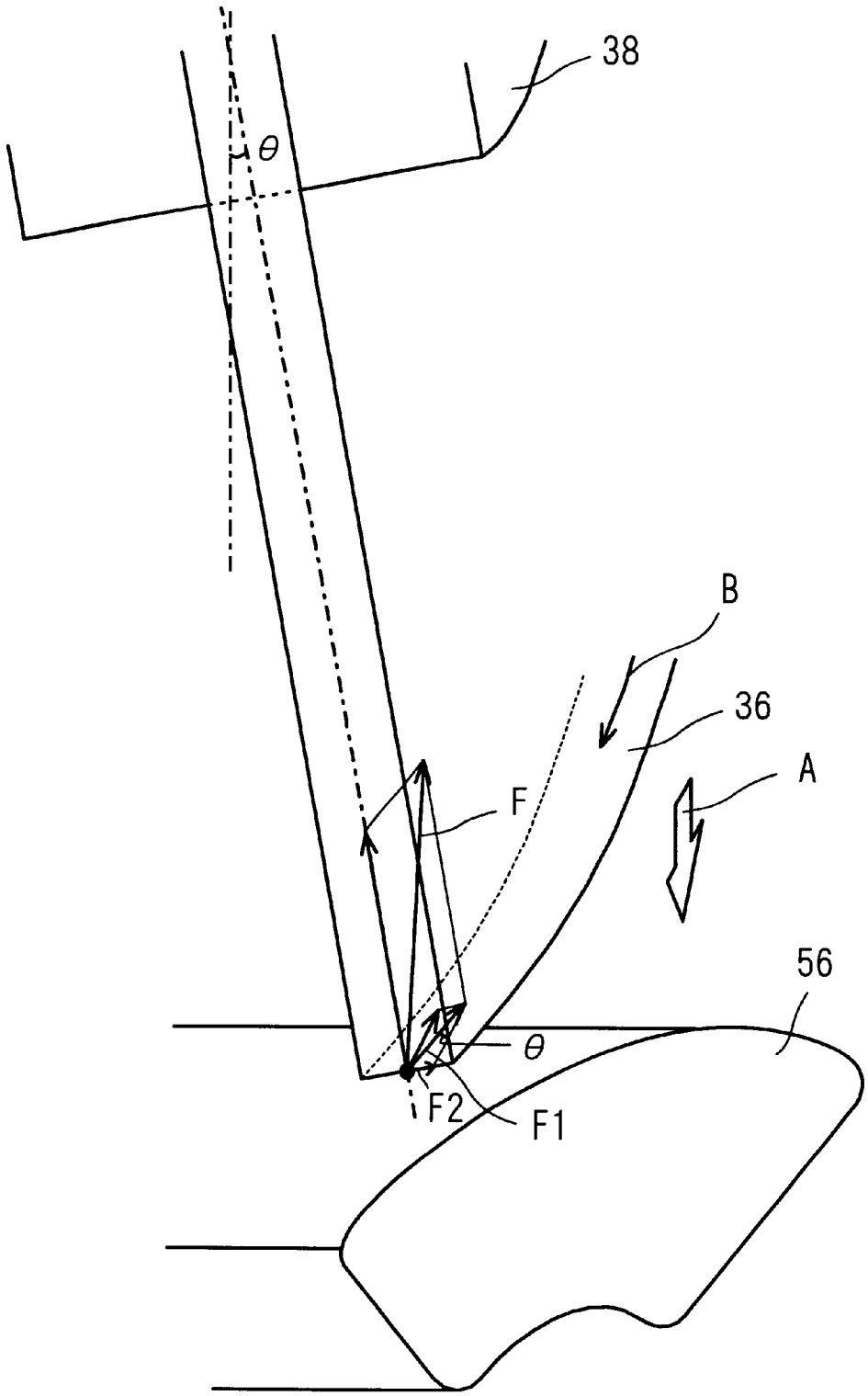
FIG. 6 is a diagram showing relationship of cutting reaction forces acting on the cutting blade during a Z-feed cutting.

On the contrary, as shown in FIG. 6, according to the work cutting apparatus 10 in which the work 56 is cut in Z-feeding indicated by the arrow A (i.e. by moving the cutting blade 36 vertically), even if there is the cutting blade mounting error $\theta$, a tangential component force F1 becomes smaller because the cutting reaction F acts generally toward the center of the rotating shaft 28. Inevitably therefore, a component force F2 ($=F1\times\sin\theta$) which deforms the cutting blade 36 becomes smaller than in the case shown in FIG. 5. This reduces the load acting on the cutting blade 36, and thus makes the cutting blade 36 less susceptible to the deformation. Further, according to the work cutting apparatus 10, as shown in FIG. 1, since the works 56 are disposed in a shape of v and the cutting is made vertically (in the vertical cutting direction), the works 56 are not displaced by a pressing force at the time of the cutting. Therefore, it becomes possible to improve the cutting accuracy. The cutting accuracy is also improved even if the cutting blades 36 are formed by electrocasting and there is no mirror symmetry in the thickness of the cutting blades 36.

Figure 7:
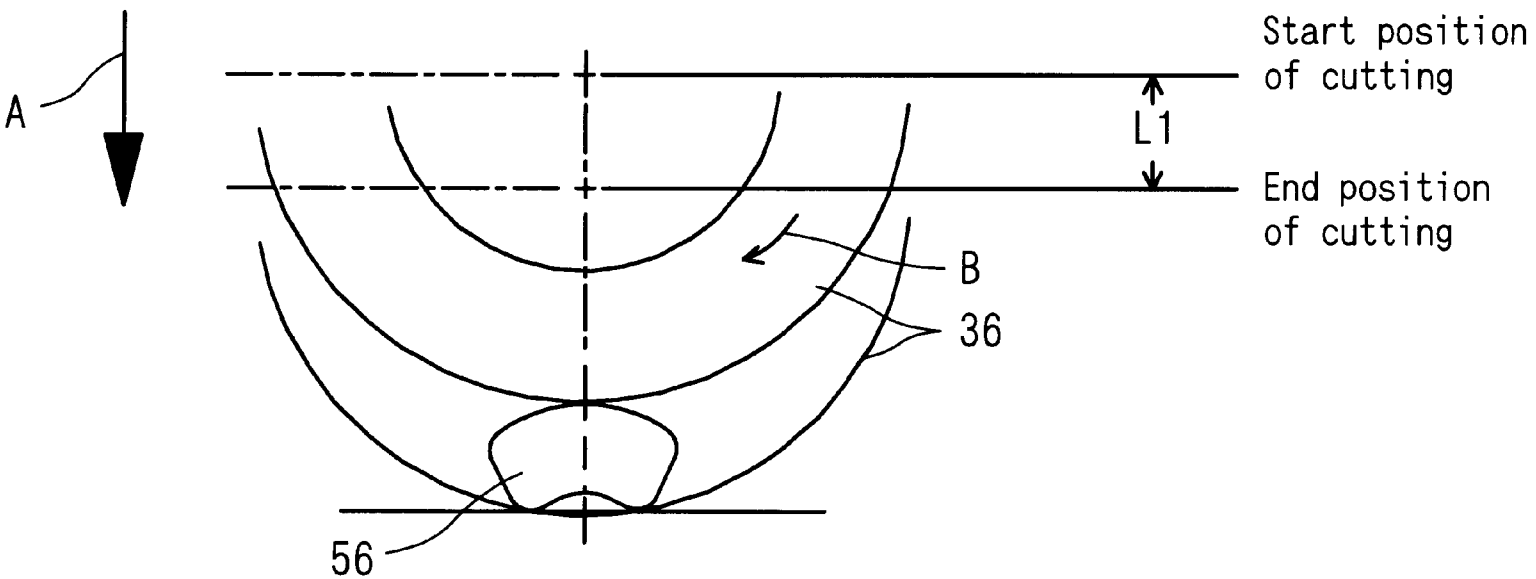
FIG. 7 is a diagram showing a cutting stroke in the Z-feed cutting.
Figure 8:
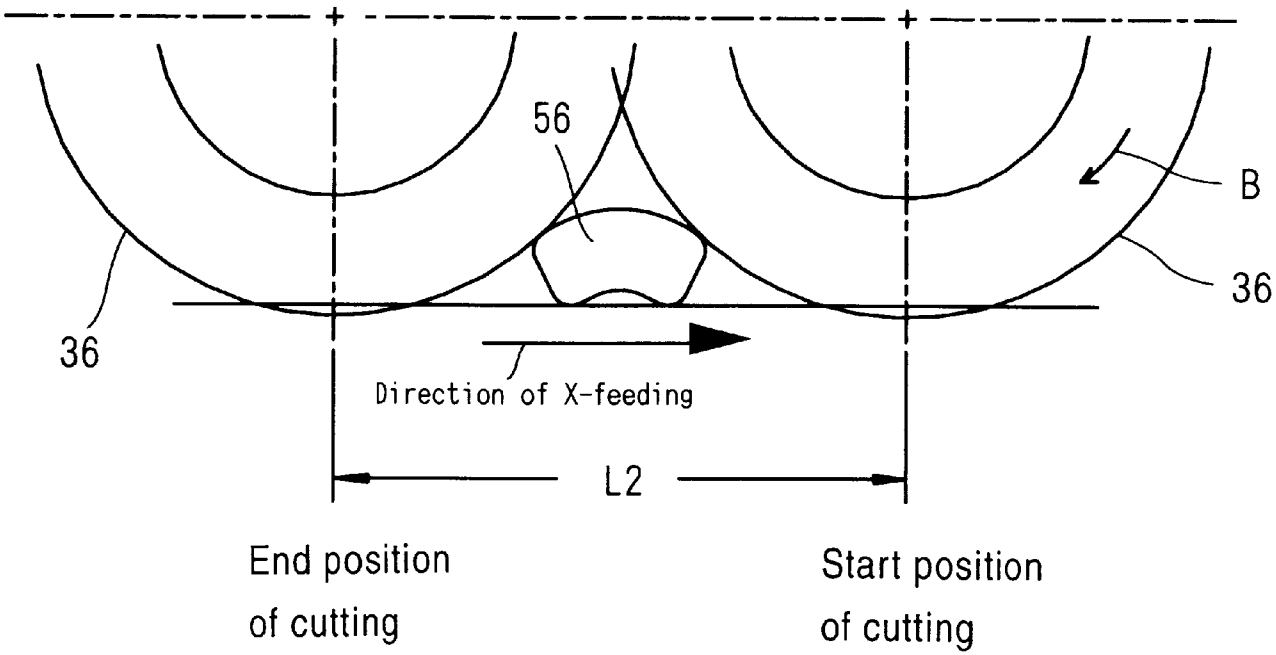
FIG. 8 is a diagram showing a cutting stroke in the X-feed cutting.

Further, as shown in FIG. 7, a stroke L1 of the cutting blades 36 from a start position of cutting to an end position of the cutting by the work cutting apparatus 10 can be shortened as compared to a stroke L2 in the X-feeding shown in FIG. 8. If a plurality of the works 56 are placed side by side as shown in FIG. 1, the stroke can be further shortened than in the X-feeding, and the effect is more remarkable.

Further, by rotating the cutting blades 36 at a high speed not slower than 8000 rpm, the dynamic rigidity of the cutting blades 36 can be increased by centrifugal force, the cutting blades 36 becomes less susceptible to the deformation, and the works 56 can be cut stably. Since the dynamic rigidity of the cutting blades 36 can be increased as above, size of the cutting blades 36 can be made relatively large without causing a problem for use, with an amount of projection E (See FIG. 2.) made larger than 25 mm. The cutting blades 36 having the amount of projection E of about 30 mm are also usable.

Therefore, according to the work cutting apparatus 10, even if the works 56 to be cut are relatively thick, it becomes possible to reduce the amount of material ground off the works 56, and to improve cutting accuracy. The effect is particularly remarkable when cutting a thick work which is the rare-earth alloy magnet member made of the hard, brittle and difficult-to-cut neodymium alloy and so on.

It should be noted here that the rigidity necessary for cutting increases when the cutting speed is increased. Therefore, the effect of the high-speed rotation of the cutting blades 36 becomes more remarkable when the cutting speed is increased.

The above described effect can also be obtained when the works 56 are cut along the normal line passing the tangential point between the cutting blades 36 and the works 56.

Further, since the works 56 are submerged in the coolant 52 when the works 56 are cut, the coolant 52 can be supplied sufficiently to the cutting region 60 even if the clearance between the works 56 and the cutting blades 36 is small. Further, by rotating the cutting blades 36 at a high speed as described above, dynamic rigidity of the cutting blades 36 is increased. Therefore, the cutting blades 36 are not distorted during the cutting, and thus side surfaces of the cutting blades 36 do not contact the works 56 during the cutting. Thus, even if the works 56 to be cut has a relatively tall height (in the feeding direction), seizure of the cutting blades 36 can be eliminated, making possible to increase the life of the cutting blades 36. Further, by supplying the coolant 52 positively from the hose 58 to the cutting region 60 of the works 56, it becomes possible to sufficiently submerge the works 56 in the coolant 52, and the seizure of the cutting blades 36 can be eliminated more reliably.

Figure 9:
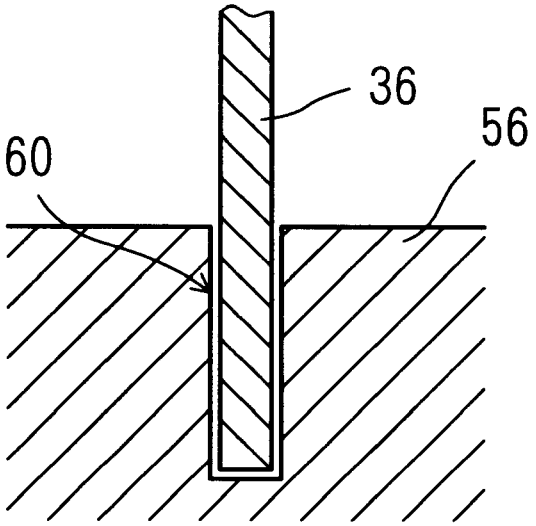
FIG. 9 is a diagram showing a state in which the cutting blade is advanced into a work.
Figure 10A:
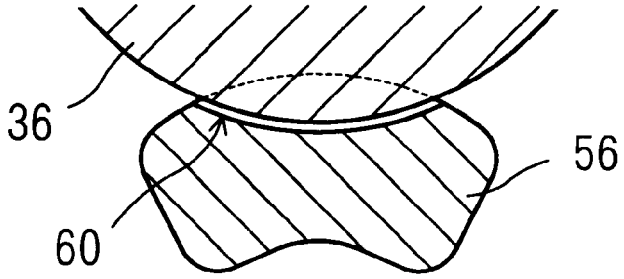
FIG. 10A~FIG. 10C are diagrams for describing a clearance between the work and the cutting blade when the work is vibrated.
Figure 10B:
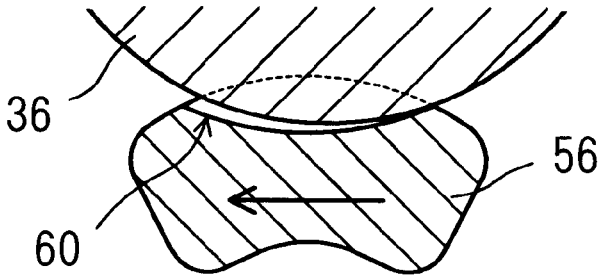
Figure 10C:
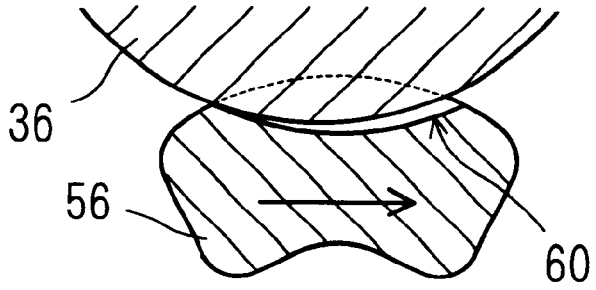

Further, since there is only a small difference in the thickness between an outer circumferential portion and a center portion of the cutting blade 36, as shown in FIG. 9, the clearance between the cutting blade 36 and the cutting region 60 of the work 56 is small. However, by vibrating the vibration table 46, i.e. the work 56, in parallel to the main surfaces of the cutting blade 36 and perpendicularly to the direction of feeding of the cutting blade 36, the cutting blade 36 can be periodically spaced from the cutting region 60 at the time of the cutting, as shown in FIG. 10A~FIG. 10C. This makes easy to supply the coolant 52 to the cutting region 60 and promotes discharge of the sludge. Further, the cutting blade 36 is allowed to come back from a deformed state to a correct shape during the cutting. Further, since the cutting load acting onto the cutting blade 36 can be reduced, the cutting blade 36 is less susceptible to deformation. Therefore, the cutting accuracy can be improved.

These effects, as described above, obtained by vibrating the works 56 becomes more remarkable when the cutting speed is increased.

Next, description will cover experiment examples in which the works 56 are cut by using the work cutting apparatus 10.

Figure 11:
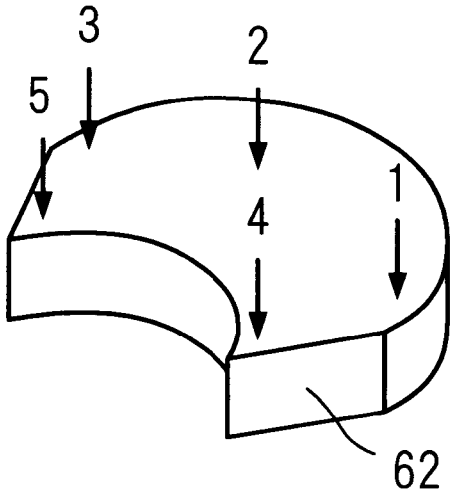
FIG. 11 is a diagram showing points of measurement for a thickness of a member obtained by a cutting.

The following experiment examples 1~3 were conducted under conditions shown in Table 1. As shown in FIG. 11, thickness was measured at five points in each of the members 62 obtained by cutting the works 56, and a difference between a maximum value and a minimum value of the thickness measurements was calculated to obtain dimensional inconsistency.

| | | |
|---|---|---|
| Cutting blade | Diamond abrasive grain + Ni + Co + Other alloys | |
| | Abrasive grain: | Diamond (artificial) |
| | Grain diameter: | 30 $\mu$m ~ 40 $\mu$m |
| | Dimensions: | |
| | Outer diameter; | 150 mm |
| | Blade thickness; | 0.3 mm |
| | Inner diameter; | 60 mm |
| | Two blades assembled in a block | |
| Spacer | Dimensions: | |
| | Outer diameter; | 110 mm |
| | Thickness; | 2.0 mm |
| | Inner diameter; | 60 mm |
| Coolant | Discharge pressure: | 2 kgf/cm$^2$ ~ 4 kgf/cm$^2$ |
| | Type of coolant: | Chemical solution type 2% dilution |
| | Surface tension: | 25 dyn/cm ~ 60 dyn/cm |
| Container | Volume: | 2 liters |
| | Dimensions: | 150 mm X 190 mm X 70 mm |
| Work | Rare-earth alloy magnet member (R-Fe-B magnet) | |
| | Dimensions: | 60 mm X 40 mm X 20 mm |
| | Target thickness: | 2.1 mm |

EXPERIMENT EXAMPLE 1

Two kinds of cutting were made: In a Z-feed cutting the cutting blades 36 were fed vertically to the works 56, whereas in an X-feed cutting the cutting blades 36 were fed horizontally to the works 56. In both cases, the coolant 52 was supplied to the works 56 by discharge from the hose 58, and the cutting blades 36 were rotated at a speed of 8000 rpm.

The cutting speed was 2 mm/min for the Z-feed cutting and 5 mm/min for the X-feed cutting. The cutting was made twice for the Z-feed cutting, and the measurements were averaged. It should be noted here that in FIG. 12A, FIG. 13A and FIG. 14A, the term "Left side" refers to the member 62 yielded inside the cutting blades by cutting the work 56 shown on the left-hand side in FIG. 1. Likewise, the term "Right side" refers to the member 62 yielded inside the cutting blades by cutting the work 56 shown on the right-hand side in FIG. 1. "Total" column shows dimensional inconsistency represented by the difference between a maximum value and a minimum value from a total of 10 thickness measurements made to both (left and right) inside members 62.

Figures 12A, 12B:
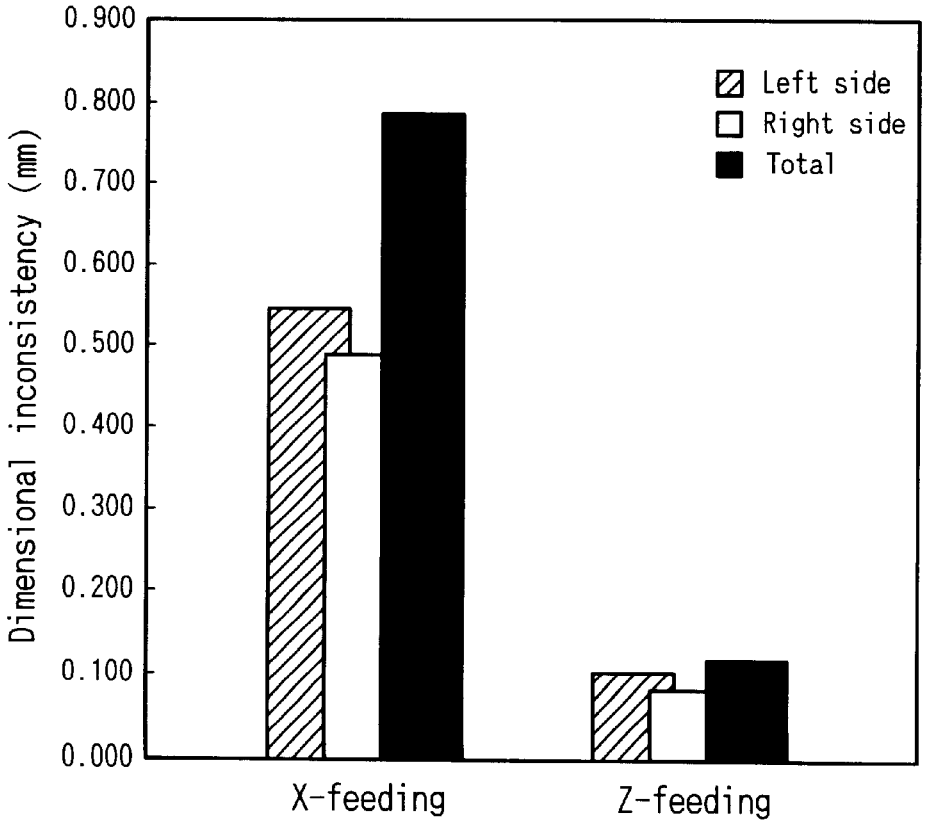
FIG. 12A is a table showing results of an experiment example 1.
FIG. 12B is a graphical representation of the same.

From experimental results shown in FIG. 12A and FIG. 12B, it is learned that the dimensional inconsistency is smaller and the cutting accuracy is better in the Z-feed cutting than in the X-feed cutting.

EXPERIMENT EXAMPLE 2

Next, the Z-feed cutting was performed at two rotating speeds of the cutting blades of 8000 rpm and 3600 rpm. Four different cutting speeds of 1 mm/min, 2 mm/min, 4 mm/min and 6 mm/min were used for the cutting blade rotating speed of 8000 rpm. Three different cutting speeds of 1 mm/min, 2 mm/min and 3 mm/min were used for the cutting blade rotating speed of 3600 rpm. In each case, the works 56 were submerged in the coolant 52 in the container 50. It should be noted here that the script "n=3" shown in FIG. 13A and FIG. 14A means that the cutting was performed three times and values shown are average values.

Figures 13A, 13B:
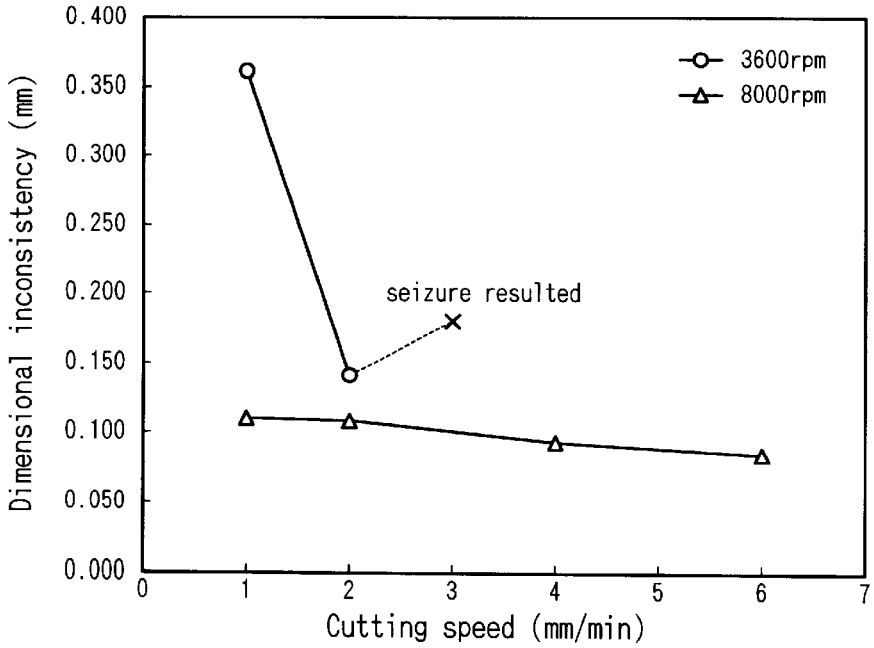
FIG. 13A is a table showing results of an experiment example 2.
FIG. 13B is a graphical representation of the same.

From the experiment results shown in FIG. 13A and FIG. 13B, it is learned that the dimensional inconsistency is smaller and the cutting accuracy is better at the cutting blade rotating speed of 8000 rpm than 3600 rpm. Further, at the cutting blade rotating speed of 3600 rpm and at the cutting speed of 3 mm/min, due to distortion of the cutting blades 36, cutting load exerted to the abrasive grain becomes too large, resulting in seizure of the cutting blades 36. On the contrary, at the cutting blade rotating speed of 8000 rpm, no seizure develops, and the life of the cutting blades 36 can be increased. Therefore, by rotating the cutting blades 36 at a high speed, the cutting accuracy can be improved and the life of the cutting blades 36 can be increased. This effect becomes more remarkable if the amount of projection E is not smaller than 25 mm.

EXPERIMENT EXAMPLE 3

Further, the Z-feed cutting was performed for two different cases: In one case the works 56 were submerged in the coolant 52 in the container 50, whereas in the other case the coolant 52 was discharged to the works 56 from the hose 58. In each case the cutting blade rotating speed was 8000 rpm. For the case in which the works 56 were submerged in the coolant 52 in the container 50, four different cutting speeds of 1 mm/min, 2 mm/min, 4 mm/min and 6 mm/min were used. For the case in which the coolant 52 was discharged to the works 56, three different cutting speeds of 1 mm/min, 2 mm/min and 3 mm/min were used.

Figures 14A, 14B:
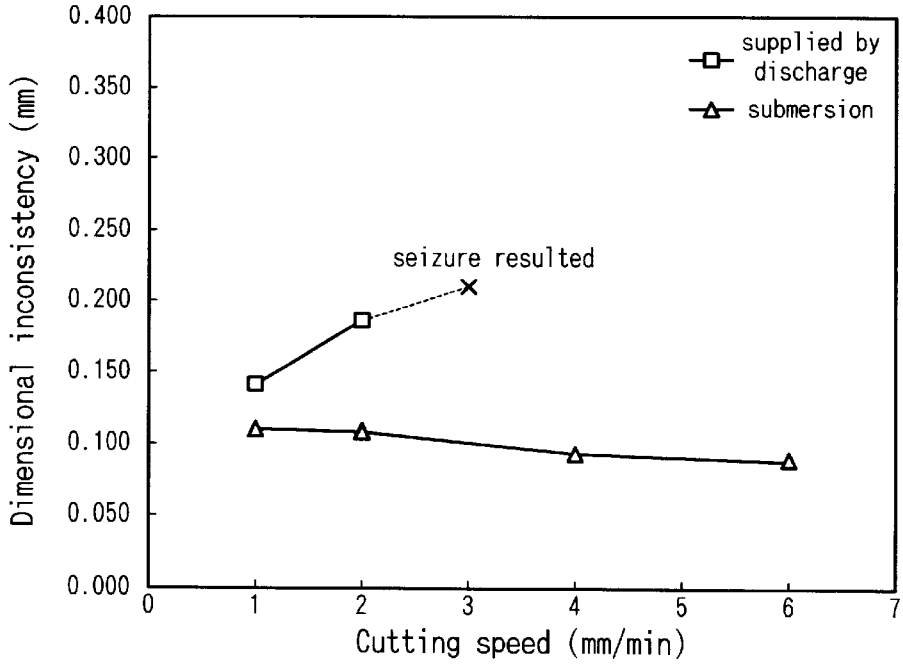
FIG. 14A is a table showing results of an experiment example 3.
FIG. 14B is a graphical representation of the same.

From the experiment results shown in FIG. 14A and FIG. 14B, it is learned that in the case where the coolant 52 is supplied by discharging, seizure of the cutting blades 36 develops if the cutting speed is 3 mm/min, since the supply of the coolant 52 to the cutting region 60 is interrupted by accompanying airflow drawn by the rotating cutting blades 36. On the contrary, in the case where the works 56 are submerged in the coolant 52 in the container 50, no seizure develops even if the cutting speed is 6 mm/min. Therefore, submersing the works 56 in the coolant 52 better prohibits the seizure even at a higher cutting speed, resulting in better cutting and increased life of the cutting blades 36. Further, submersing the works 56 in the coolant 52 gives better dimensional inconsistency and cutting accuracy.

Specifically, if the blade thickness D of the cutting blades 36 is 0.3 mm, the clearance is small and supply shortage of the coolant 52 can develop easily. Therefore, in order to sufficiently supply the works 56 with the coolant 52, it is effective to submerge the works 56 in the coolant 52 in the container 50.

Figure 15:
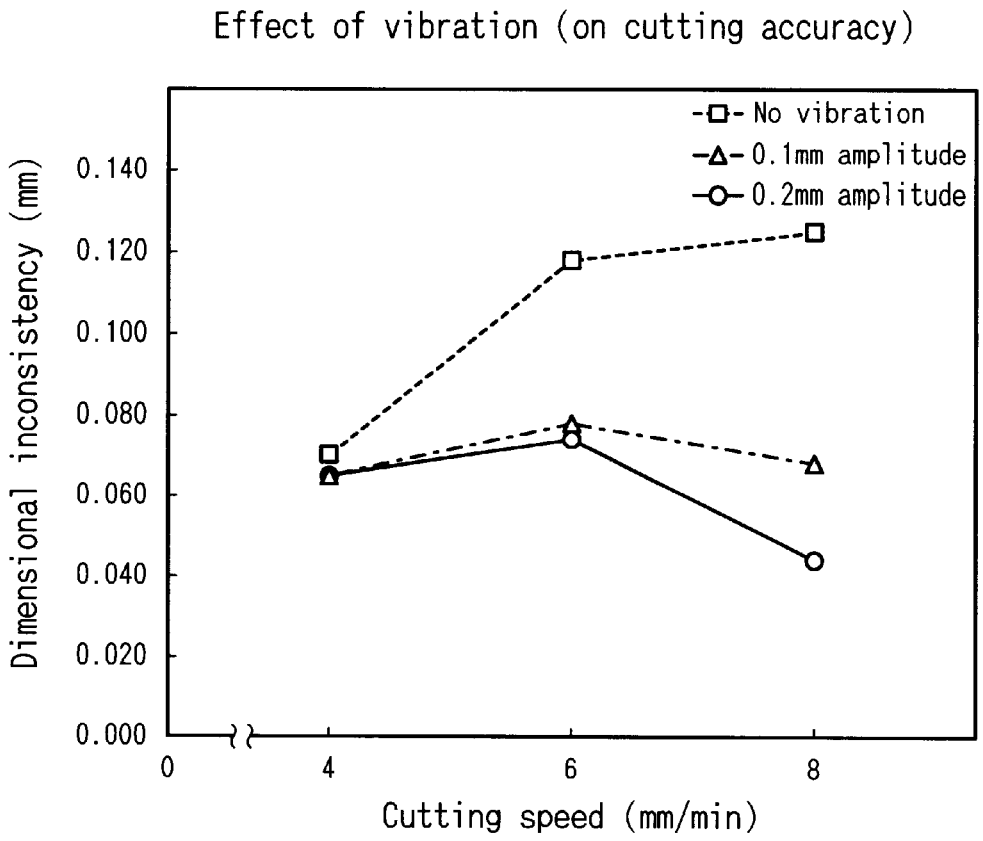
FIG. 15 is a graph showing cutting accuracy in a vibratory cutting.

Further, according to the work cutting apparatus 10, as understood from FIG. 15, the dimensional inconsistency is decreased and the cutting accuracy is improved if the works 56 are vibrated (at 20 Hz in this experiment) during the cutting than if the works 56 are not vibrated. The effect becomes more remarkable when the cutting speed is increased.

Figure 16A:
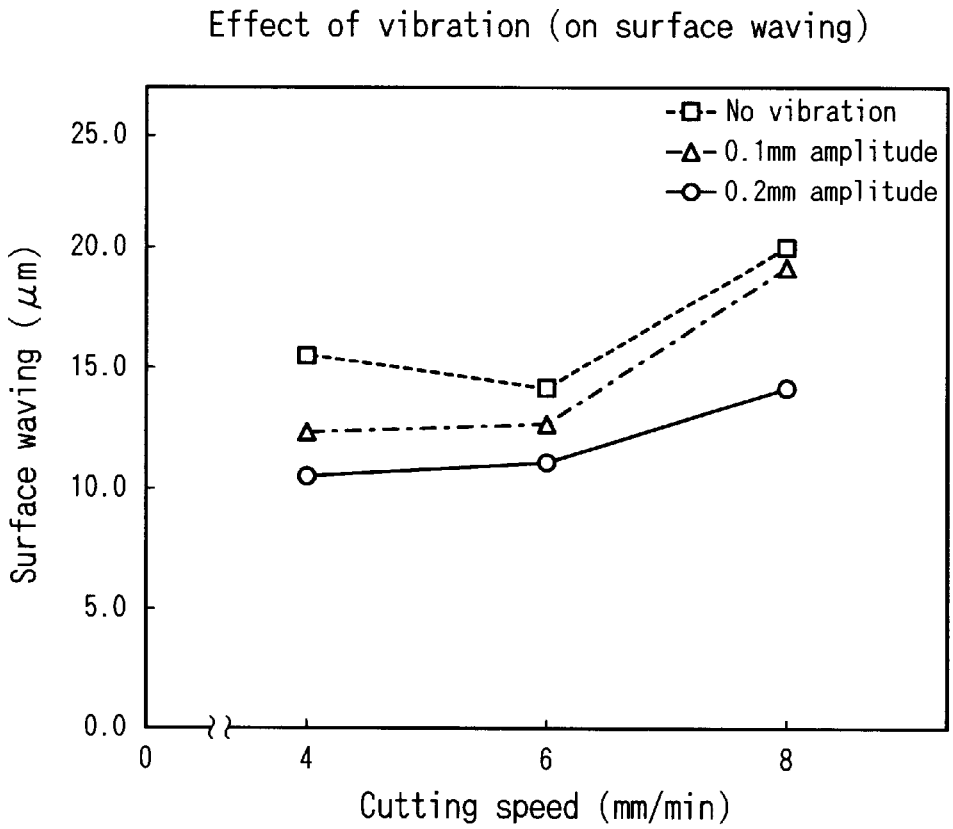
FIG. 16A is a graph showing surface waviness in the vibratory cutting.

Further, as shown in FIG. 16A, by adding vibration during the cutting, waving of the cut surface (surface waviness) can also be made smaller, resulting in improved flatness.

Figure 16B:
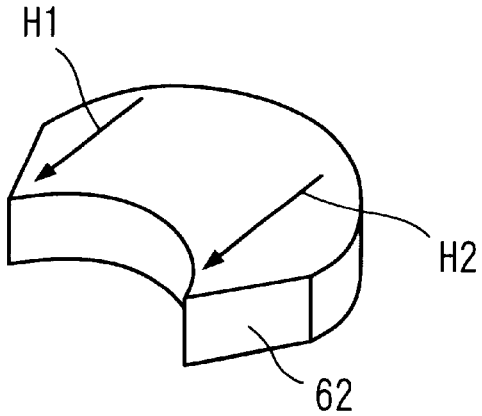
FIG. 16B is a diagram showing points of measurement for the surface waviness.

Here, the surface waviness is obtained in the following method. First, on a surface of the member 62 obtained by cutting the works 56, heights of the surface are measured by running a measuring instrument (not illustrated) in each of directions indicated by arrows H1 and H2 in FIG. 16B. A difference between a maximum measurement and a minimum measurement is obtained for each of the directions indicated by the arrows H1, H2, and then the differences are averaged to represent the surface waviness.

Figures 17A, 17B:
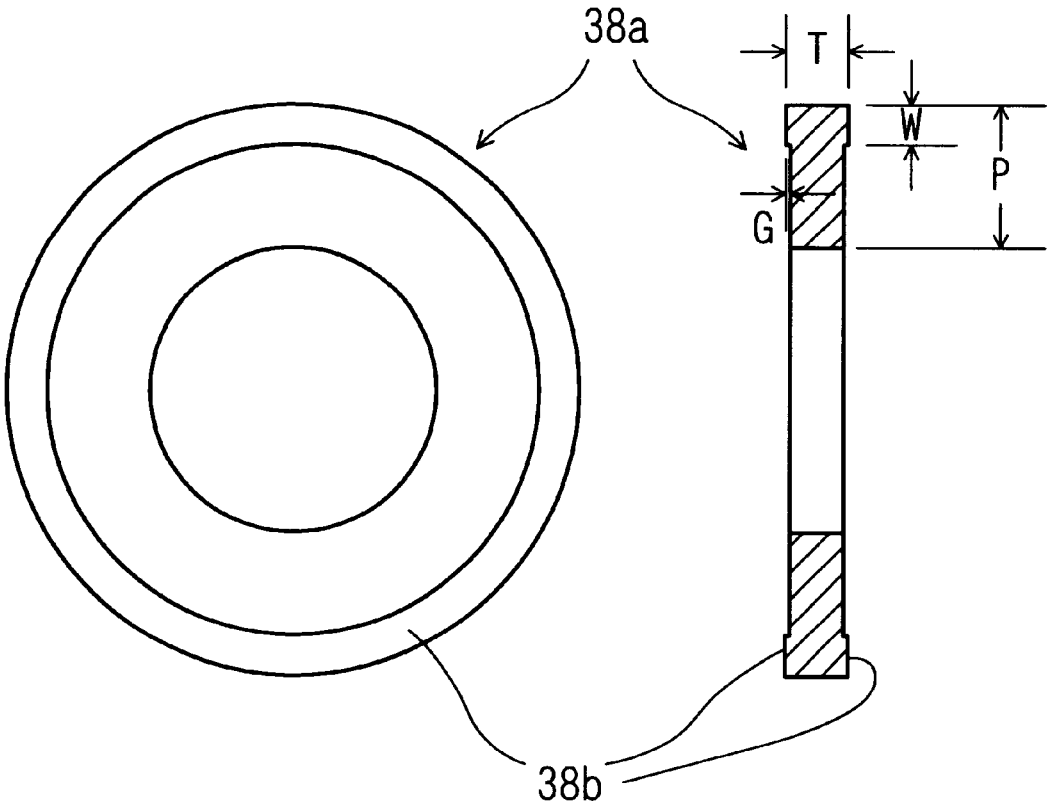
FIG. 17A is a front view showing a variation of a spacer.
FIG. 17B is a sectional view of the same.

It should be noted here that in the work cutting apparatus 10, a spacer 38*a* as shown in FIG. 17A and FIG. 17B may be used.

The spacer 38*a* is formed as a doughnut-shaped disc with two main surfaces each having an outer circumferential portion formed with an annular stepped portion 38*b*, and inserted between the cutting blades 36.

Here, description will cover the experiment example 4 which was conducted concerning the annular stepped portion 38*b*.

EXPERIMENT EXAMPLE 4

The Z-feed cutting was performed for two cases: In one case, a spacer 38 shown in FIG. 2 which is not formed with the annular stepped portions 38*b* was used, whereas in the other case, the spacer 38*a* shown in FIG. 17A and FIG. 17B, formed with the annular stepped portions 38*b* was used.

In both cases, five cutting blades 36 were assembled into the cutting blade block, with the amount of projection E=20 mm. The cutting speed was 2 mm/min, the cutting blade rotating speed was 8000 rpm, and the target thickness was 2.0 mm. The works 56 were submerged in the coolant 52 in the container 50, the coolant 52 was supplied to the works 56 from the hose 58 at a discharging pressure of 2 kgf/cm$^2$. Dimensions of the spacer 38*a* were: 110.0 mm in outer diameter, 60.0 mm in inner diameter, thickness T=2.0 mm, contact width W=9.0 mm, clearance in the stepped portions G=0.1 mm. The other conditions including the dimensions of the spacer 38 were identical with those listed in Table 1.

One work 56 was disposed on a pasting board having a flat upper surface, and was cut by the cutting blade block of five cutting blades 36, yielding four inside members 62 (No. 1~No. 4), for which the dimensional inconsistency and parallelism were measured. The cutting was performed three times for each case, and the measurements were averaged.

The "parallelism" was obtained in the following method. specifically, for each of the members 62 obtained by cutting the works 56, the thickness was measured at five predetermined locations shown in FIG. 11, and a difference between a maximum value and a minimum value was obtained. This operation was performed to each of the members 62 obtained, and the difference between the maximum value and the minimum value was calculated for each of the members 62 and averaged to give the parallelism.

The dimensional inconsistency in the experimental example 4 is the difference between the maximum value and the minimum value obtained from a total of 20 measurements made for the four members 62 (No. 1~No. 4).

From the experimental results shown in FIG. 18A and FIG. 18B, it is learned that the dimensional inconsistency and the parallelism are smaller and cutting accuracy is better in the case where the spacer 38*a* having the annular stepped portions 38*b* was used than in the case where the spacer 38 having no annular stepped portion 38*b* was used. This is presumably that when the spacer 38*a* is assembled to the cutting blade 36, the spacer 38*a* has a smaller area of contact with the super hard abrasive grain 42 dispersed in the side surface of the cutting blade 36, resulting in smaller interference from the super hard abrasive grain 42 and accordingly smaller amount of tilt of the cutting blade 36. Further, the spacer 38*a* formed with the annular stepped portions 38*b* has a smaller area of contact with the cutting blade 36 than does the spacer 38. This presumably makes assembling force concentrate on the edge portion, fastening the cutting blade 36 more firmly.

It should be noted here that the contact width W of the annular stepped portions 38*b* is preferably about ⅓ of a difference P between the outer diameter and the inner diameter of the spacer 38*a*. In this case, the cutting blades 36 can be reliably held at the time of cutting, and the tilt of the cutting blade 36 can be reduced.

Figure 19A:
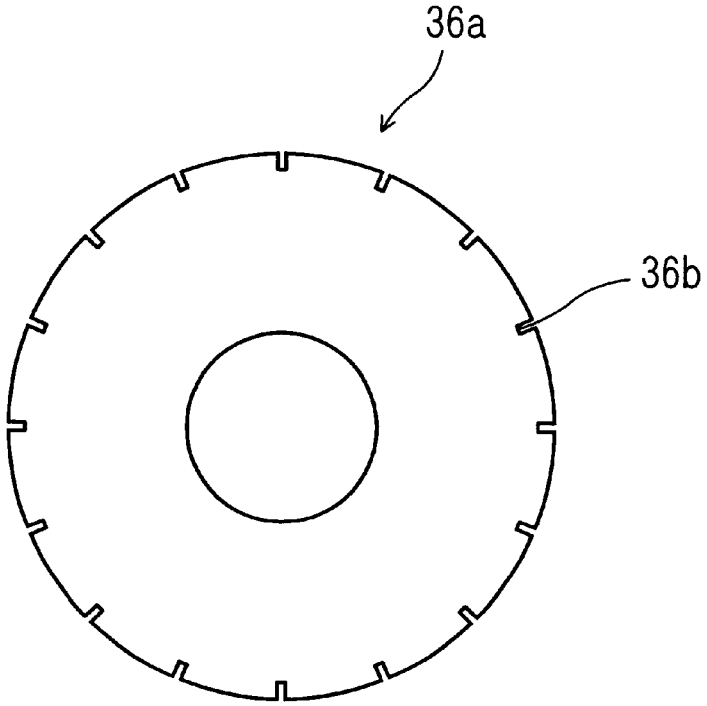
FIG. 19A is a front view showing a variation of the cutting blade.

Further, a cutting blade 36*a* as shown in FIG. 19A may be used as the cutting blade.

The cutting blade 36*a* is formed by forming cutouts 36*b* at a tip portion of the cutting blade 36. The cutout 36*b* for example, has a width of 1 mm, a depth of 2 mm and a total of sixteen cutouts are formed at an interval, dividing an outer circumference of the cutting blade 36*a* into sixteen equal portions.

Description will now cover the experiment example 5 which was conducted concerning the cutouts 36*b*.

EXPERIMENT EXAMPLE 5

The Z-feed cutting was performed for two cases: In one case, the cutting blade 36 which does not have the cutouts 36*b* was used, whereas in the other case, the cutting blade 36*a* which has the cutouts 36*b* as shown in FIG. 19A was used.

In both cases experimental conditions were as follows: The spacer 38 was used; four of the cutting blades 36 and 36*a* were assembled into the cutting blade blocks respectively, with the amount of projection E=20 mm; the works 56 were submerged in the coolant 52 in the container 50; and the coolant 52 was supplied to the works 56 from the hose 58 at a discharging pressure of 2 kgf/cm$^2$. The other conditions were identical with those listed in Table 1.

Two works 56 were disposed on the pasting board 54, having an upper surface of a generally V-shaped section, and were cut by the cutting blade block of four cutting blades 36 or 36*a*. The dimensional inconsistency was measured for six inside members 62 obtained.

In the experimental example 5, the "dimensional inconsistency" was obtained in the following method.

Specifically, for the six members 62 obtained, the thickness was measured at a total of thirty locations, and a difference between a maximum value and a minimum value was obtained. This operation was performed in each of the cutting operation, and the differences obtained were averaged to give the dimensional inconsistency. In the experiment example 5, the cutting operation was performed three times and the obtained values were averaged per case.

Two cutting blade rotating speeds, i.e. 8000 rpm and 3600 rpm were used. In each of the speeds, cutting operation was made for three different cutting speeds of 2 mm/min, 4 mm/min and 6 mm/min, and the dimensional inconsistency was calculated in each of the cases.

Figures 20A, 20B:
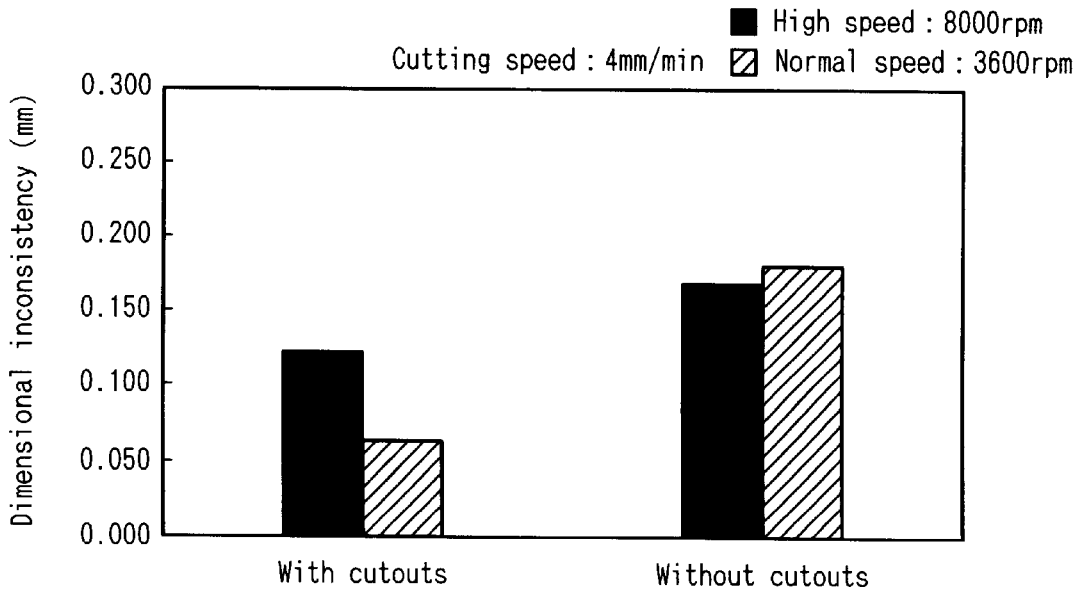
FIG. 20A is a table showing results of an experiment example 5.
FIG. 20B is a graphical representation of the same.

As understood from the experimental results shown in FIG. 20A and FIG. 20B, the coolant 52 is supplied to the blade cutting edge more easily and the dimensional inconsistency becomes smaller in the case where the cutting blade 36*a* having the cutouts 36*b* is used than in the case where the cutting blade 36 which does not have the cutouts 36*b* is used. The dimensional inconsistency is especially small when the cutting blade rotating speed is normal (3600 rpm).

Figure 19B:
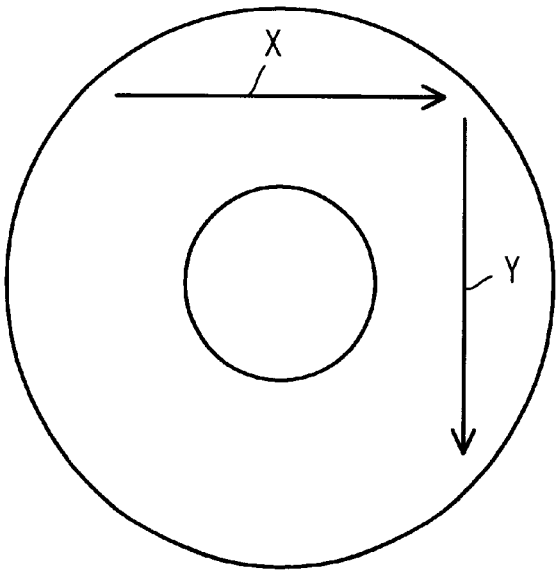
FIG. 19B is a diagram for describing a distortion.

Further, in the work cutting apparatus 10, when the cutting blade 36*a* was used as the cutting blade and the spacer 38*a* was used as the spacer, the dimensional inconsistency was decreased to not greater than 0.1 mm, with the amount of projection E being not greater than 20 mm. At this time, distortion of the cutting blade 36*a* was not greater than 30 $\mu$m. The "distortion" was obtained by averaging a maximum value and a minimum value of the surface height, for each of two directions indicated by an arrow X and an arrow Y in FIG. 19. The measurement can be made by using a tracing-needle type contour measuring instrument for example.

As the coolant 52, a synthetic chemical type coolant having a high permeability was found effective, and the dimensional inconsistency was decreased by providing the cutouts 36*b* as in the cutting blade 36*a*.

Figure 21:
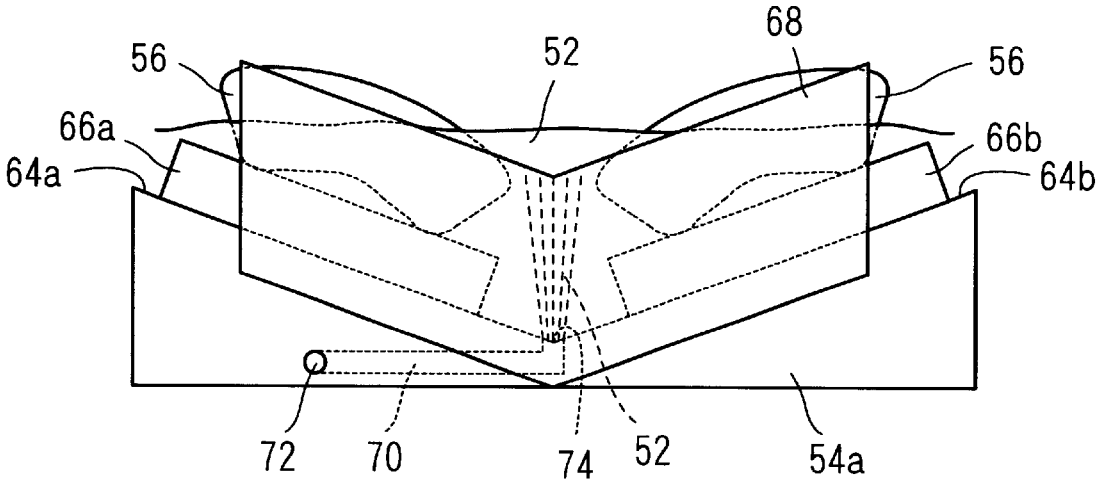
FIG. 21 is a diagram showing an example of a pasting board and an example of an enclosing member.

It should be noted here that as shown in FIG. 21, in the work cutting apparatus 10, an arrangement may be used in which a pasting board 54*a* provided with a surface (upper surface) having a V-shaped section is used, and the coolant 52 is supplied from a bottom portion of the upper surface of the pasting board 54*a*, without using the container 50.

Specifically, the pasting board 54*a* has sloped surfaces 64*a*, 64*b* provided with disposition plates 66*a*, 66*b* respectively. The works 56 are disposed on the disposition plates 66*a*, 66*b* respectively. In order to hold the coolant 52, a plate-like enclosing member 68 is attached to each side surface of the pasting board 54*a*. A coolant supplying path 70 is formed inside the pasting board 54*a*. The coolant 52 is sent from a hole 72 provided on the side surface of the pasting board 54*a* into the coolant supplying path 70. The coolant 52 is then discharged upward from supplying ports 74 made of a plurality of holes for example formed on the bottom portion of the upper surface of the pasting board 54*a*.

By supplying the works 56 with the coolant 52 not only from the hose 58 but also from beneath as described above, it becomes possible to sufficiently supply the coolant 52 to the cutting region 60. An amount of discharge of the coolant 52 from the hose 58 is preferably 50 L/min~200 L/min.

Figure 22A:
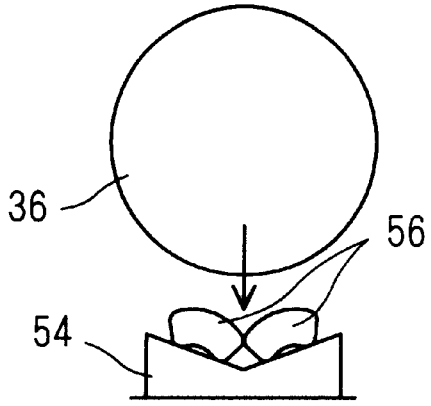
FIG. 22A~FIG. 22F are diagrams showing variations of the mode of cutting the works.
Figure 22B:
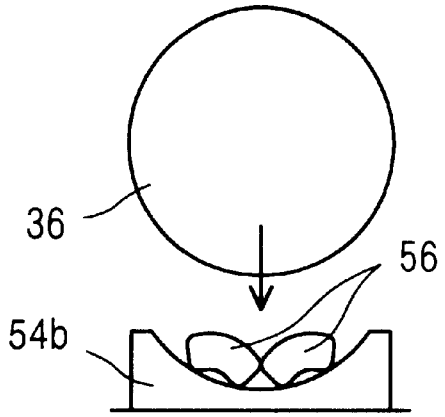
Figure 22C:
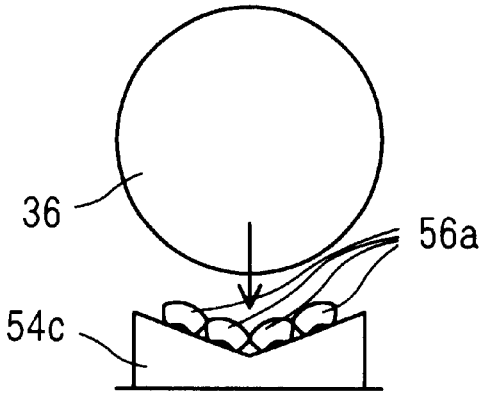
Figure 22D:
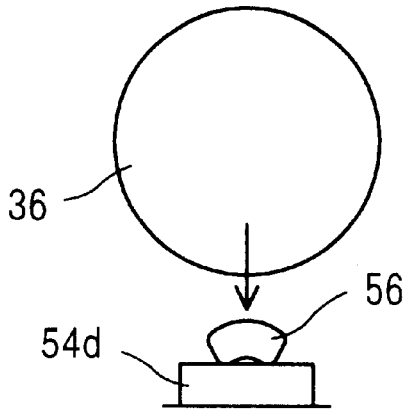
Figure 22E:
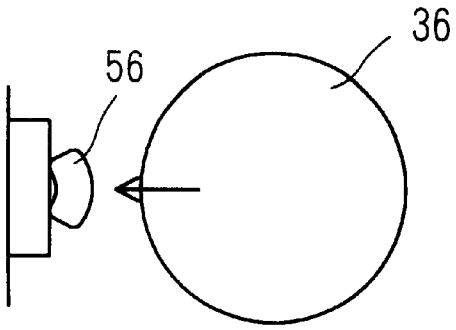
Figure 22F:
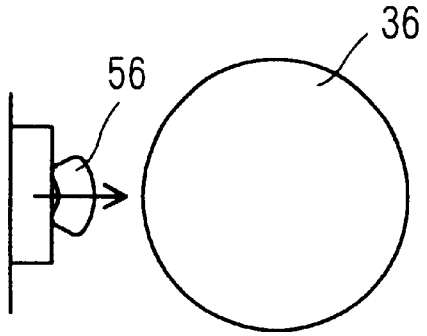

Further, the present invention is not limited to the cases in which the pasting board 54 having a generally V-shaped section is used as shown in FIG. 22A. Alternatively, as shown in FIG. 44B, a pasting board 54*b* formed with a groove having an arcuate section of a curvature generally equal to that of an outer circumference of the cutting blade 36 may be used. Further, as shown in FIG. 22C, four works 56*a* may be disposed in a single row on the pasting board 54*c*. Further, as shown in FIG. 22D, the cutting may be made vertically to the work 56 which is disposed on a pasting board 54*d* having a flat upper surface. Further, as shown in FIG. 22E, the cutting of the work 56 may be made by horizontally feeding the cutting blades 36 along the normal line passing the tangential point with the work 56 disposed vertically. Still further, as shown in FIG. 22F, the work 56 may be disposed vertically and fed horizontally so as to cut the work 56 along the normal line passing the tangential point with the cutting blades 36. In each of these cases, as shown in FIG. 6, the load exerted to the cutting blades 36 is decreased and the cutting blades 36 become less susceptible to deformation, and therefore the cutting accuracy is improved. The present invention is not limited to the case in which the cutting blades 36 are moved toward the work at the time of cutting. Alternatively, the work may be moved toward the cutting blades 36. The same applies to a case in which the cutting blade 36*a* is used.

It should be noted here that the cutting blades 36, 36*a* may not necessarily be of an electrocasting type, but may be of any type falling in an all-blade cutter category, which includes a resin type and a metal type disclosed in the Japanese Patent Publication (of examined Application for opposition) No. 52-33356.

A cutter wheel included in the metal bond cutter disclosed in the Japanese Patent Publication (of examined Application for opposition) No. 52-33356 is obtained as follows.

Specifically, first, a metal powder comprising 1%~18% by weight of Sn, 1%~20% of Ag, 5%~45% of one or more of Fe, Ni, Co and Cr, with the remaining portion being Cu is mixed uniformly with an abrasive grain made of natural diamond, synthetic diamond and so on. The mixture is pressed and formed into a compact of a predetermined dimensions and shape in a cold working process, and then sintered in a reducing atmosphere or a neutral atmosphere. Grain size of the diamond used in this case is #140/170~600 mesh (100 $\mu$m~30 $\mu$m approx.). Mixing rate of the diamond may be 5%~30% by volume of the entire cutter wheel, though the rate may vary depending on application. Pressure used in the cold forming operation of the cutter wheel is 1 ton/cm$^2$~5 ton/cm$^2$, and the sintering temperature is 650° C.~900° C.

Alternatively, a sintered diamond alloy which is an alloy made by sintering diamond, cBN or the like with a hard alloy, as disclosed in the Japanese Patent Laid-Open Nos. 8-109431 and 8-109432, may be used in the cutting blades 36, 36*a*.

The metal plate phase 40 may not necessarily be made of Ni and Co, but may be made of any other metal elements as long as the rigidity of the cutting blade can withstand the cutting.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A work cutting apparatus for cutting a work, comprising:

a plurality of cutting blades each having a surface containing a super hard abrasive grain dispersed entirely therein;

a spacer inserted between the cutting blades, the spacer including two main surfaces each having an outer circumferential portion formed with an annular stepped portion;

first driving means for rotation of the cutting blade; and second driving means for moving at least one of the cutting blade and the work for cutting work.

2. The apparatus according to claim 1, wherein a direction of movement of the cutting blade relative to the work at a time of cutting is vertical to the work.

3. The apparatus according to claim 1, wherein a direction of movement of the cutting blade relative to the work at a time of cutting is along a normal line passing a tangential point between the cutting blade and the work.

4. The apparatus according to claim 1, further comprising a container holding a coolant for submerging the work, wherein the work is submerged in the coolant when cutting.

5. The apparatus according to claim 4, further comprising coolant supplying means for supply of the coolant to the work.

6. The apparatus according to one of claims 2 through 4, wherein the cutting blade includes a metal plate phase containing the super hard abrasive grain dispersed thereon.

7. The apparatus according to one of claims 2 through 4, wherein the cutting blade has a tip portion formed with a cutout.

8. The apparatus according to one of claim 2 through 4, wherein the cutting blade is rotated at a speed not slower than 8000 rpm.

9. The apparatus according to one of claims 2 through 4, further comprising vibrating means for vibrating the work in a direction parallel to a main surface of the cutting blade.

10. A work cutting apparatus for cutting a work, comprising:

a cutting blade having a surface containing a super hard abrasive grain dispersed entirely therein;

first driving means for rotation of the cutting blade;

second driving means for moving at least one of the cutting blade and the work in a direction in which movement of the cutting blade relative to the work at a time of cutting is vertical to the work; and vibrating means for vibrating the work in a direction parallel to a main surface of the cutting blade.

11. A work cutting apparatus for cutting a work, comprising:

a cutting blade having a surface containing a super hard abrasive grain dispersed entirely therein;

first driving means for rotation of the cutting blade;

second driving means for moving at least one of the cutting blade and the work in a direction in which movement of the cutting blade relative to the work at a time of cutting is along a normal line passing a tangential point between the cutting blade and the work, and vibrating means for vibrating the work in a direction parallel to a main surface of the cutting blade.

12. A work cutting apparatus for cutting a work, comprising:

a container holding a coolant for submerging the work, a cutting blade having a surface containing a super hard abrasive grain dispersed entirely therein;

first driving means for rotation of the cutting blade;

second driving means for moving at least one of the cutting blade and the work for cutting the work submerged in the coolant; and vibrating means for vibrating the work in a direction parallel to a main surface of the cutting blade.

13. The apparatus according to one of claims 2 through 4, wherein the work is a rare-earth alloy magnet member.

14. The apparatus according to one of claims 10 through 12, wherein a vibrating direction of the work is perpendicular to the direction of movement of the cutting blade relative to the work.

15. A work cutting method for cutting a work, comprising:

a first step of preparing a plurality of cutting blades each having a surface containing a super hard abrasive grain dispersed entirely therein, and a spacer including two main surfaces each having an outer circumferential portion formed with an annular stepped portion, and then inserting the spacer between two mutually adjacent cutting blades; and a second step of cutting the work with the cutting blade by rotating the cutting blade and moving at least one of the cutting blade and the work.

16. A work cutting method for cutting a work, comprising:

a first step of preparing a cutting blade having a surface containing a super hard abrasive grain dispersed entirely therein; and a second step of cutting the work with the cutting blade by rotating the cutting blade and moving at least one of the cutting blade and the work in a direction in which movement of the cutting blade relative to the work is vertical to the work, wherein the work is cut while being vibrated in a direction parallel to a main surface of the cutting blade in the second step.

17. A work cutting method for cutting a work, comprising:

a first step of preparing a cutting blade having a surface containing a super hard abrasive grain dispersed entirely therein; and a second step of cutting the work with the cutting blade by rotating the cutting blade and moving at least one of the cutting blade and the work in a direction in which movement of the cutting blade relative to the work is along a normal line passing a tangential point between the cutting blade and the work, wherein the work is cut while being vibrated in a direction parallel to a main surface of the cutting blade in the second step.

18. A work cutting method for cutting a work, comprising:

a first step of preparing a cutting blade having a surface containing a super hard abrasive grain dispersed entirely therein; and a second step of cutting the work submerged in a coolant with the cutting blade by rotating the cutting blade and moving at least one of the cutting blade and the work, wherein the work is cut while being vibrated in a direction parallel to a main surface of the cutting blade in the second step.

19. The method according to one of claims 16 through 18, wherein a vibrating direction of the work is perpendicular to the direction of movement of the cutting blade relative to the work.

20. The method according to claim 15, wherein a direction of movement of the cutting blade relative to the work is vertical to the work in the second step.

21. The method according to claim 15, wherein a direction of movement of the cutting blade relative to the work is along a normal line passing a tangential point between the cutting blade and the work in the second step.

22. The method according to claim 15, wherein the work submerged in a coolant is cut in the second step.

23. The method according to claim 22, wherein the coolant is supplied to the work in the second step.

24. The method according to one of claims 20 through 22, wherein the cutting blade includes a metal plate phase containing the super hard abrasive grain dispersed thereon.

25. The method according to one of claims 20 through 22, wherein the cutting blade has a tip portion formed with a cutout.

26. The method according to one of claims 20 through 22, wherein the cutting blade is rotated at a speed not slower than 8000 rpm.

27. The method according to one of claims 20 through 22, wherein the work is cut while being vibrated in a direction parallel to a main surface of the cutting blade in the second step.

28. The method according to one of claims 20 through 22, wherein the work is a rare-earth alloy magnet member.

* * * * *